US009754710B2

(12) United States Patent
Inagaki et al.

(10) Patent No.: US 9,754,710 B2
(45) Date of Patent: Sep. 5, 2017

(54) POWDER MAGNETIC CORE, METHOD OF MANUFACTURING POWDER COMPACT FOR MAGNETIC CORE, DIE AND DIE ASSEMBLY FOR MANUFACTURING POWDER MAGNETIC CORE, AND DIE LUBRICATING COMPOSITION FOR MANUFACTURING POWDER MAGNETIC CORE

(71) Applicant: HITACHI CHEMICAL COMPANY, LTD., Tokyo (JP)

(72) Inventors: Takashi Inagaki, Matsudo (JP); Chio Ishihara, Tokyo (JP); Noriyuki Nakayama, Tsukuba (JP); Jiro Shima, Matsudo (JP)

(73) Assignee: Hitachi Chemical Company, Ltd., Tokyo (JP)

( * ) Notice: Subject to any disclaimer, the term of this patent is extended or adjusted under 35 U.S.C. 154(b) by 0 days.

(21) Appl. No.: 15/025,029

(22) PCT Filed: Sep. 25, 2014

(86) PCT No.: PCT/JP2014/075345
§ 371 (c)(1),
(2) Date: Mar. 25, 2016

(87) PCT Pub. No.: WO2015/046282
PCT Pub. Date: Apr. 2, 2015

(65) Prior Publication Data

US 2016/0240294 A1 Aug. 18, 2016

(30) Foreign Application Priority Data

Sep. 27, 2013 (JP) ..... 2013-201341
Sep. 27, 2013 (JP) ..... 2013-201344

(51) Int. Cl.
*H01F 1/33* (2006.01)
*B22F 3/02* (2006.01)
*H01F 41/02* (2006.01)
*H01F 3/08* (2006.01)

(52) U.S. Cl.
CPC ..... *H01F 1/33* (2013.01); *B22F 3/02* (2013.01); *H01F 3/08* (2013.01); *H01F 41/0246* (2013.01); *B22F 2003/026* (2013.01); *C22C 2202/02* (2013.01)

(58) Field of Classification Search
CPC ..... H01F 1/33; H01F 1/24; H01F 3/08; H01F 27/255; H01F 41/02; H01F 41/0246; B22F 3/02; B22F 2003/026; C22C 2202/02; Y10T 428/2982
USPC ..... 428/404
See application file for complete search history.

(56) References Cited

U.S. PATENT DOCUMENTS 8,029,626 B2 * 10/2011 Ishihara ..... B22F 1/0062 148/104
8,062,583 B2 * 11/2011 Ishihara ..... H01F 41/0246 419/37
8,236,087 B2 * 8/2012 Mitani ..... B22F 1/0007 148/105
8,398,879 B2 * 3/2013 Muramatsu ..... B22F 1/02 148/104
8,445,105 B2 * 5/2013 Mitani ..... B22F 1/0007 428/405
9,431,171 B2 8/2016 Kusawake
2002/0189714 A1 * 12/2002 Mitani ..... H01F 41/0246 148/105
2010/0044618 A1 * 2/2010 Ishimine ..... B22F 1/0014 252/62.55
2010/0051851 A1 3/2010 Mitani et al.
2013/0056674 A1 3/2013 Inagaki et al.

FOREIGN PATENT DOCUMENTS

CN 101578669 A 11/2009
CN 102717069 A 10/2012
JP 62-71531 A 4/1987
JP H05-217777 A 8/1993
JP 2001-223107 * 8/2001
(Continued)

OTHER PUBLICATIONS

International Search Report for PCT/JP2014/075345 mailed Jan. 6, 2015; English translation submitted herewith (5 Pages).
International Preliminary Report on Patentability for WO Appln. No. PCT/JP2014/075345 mailed Apr. 7, 2016 in English.
Official Action in the counterpart Chinese application No. 201480053201.6 dated Jun. 14, 2017.
Official Action in the counterpart Japanese application No. 2015-539285 dated Jun. 6, 2017.

*Primary Examiner* — Leszek Kiliman
(74) *Attorney, Agent, or Firm* — Fitch, Even, Tabin & Flannery, LLP

(57) ABSTRACT

The compact for a magnetic core is manufactured by filling a soft magnetic powder in the die hole, pressing it to form a compact at a density ratio of the soft magnetic powder being 91% or more, and extruding it from the die hole. Before filling the soft magnetic powder to the die hole, a lubricating coating containing lubricating oil and molybdenum disulfide particles is formed on the inner surface of the die hole. It is more effective when further containing insulating ceramic particles. On the extrusion-sliding surface, the compact has a surface layer of the structure that molybdenum disulfide particles and the insulating ceramic particles are interposed between the soft magnetic powder particles, and insulation of soft magnetic powder particles in the surface layer is not destroyed by extrusion. This provides a powder magnetic core suitable for high frequency application.

17 Claims, 6 Drawing Sheets

(56) References Cited

FOREIGN PATENT DOCUMENTS

| | | | | |
|---|---|---|---|---|
| JP | 2001-223107 | A | | 8/2001 |
| JP | 2003-209010 | A | | 7/2003 |
| JP | 2004-342937 | A | | 12/2004 |
| JP | 2007-211874 | | * | 8/2007 |
| JP | 2007-211874 | A | | 8/2007 |
| JP | 4044591 | B1 | | 2/2008 |
| JP | 2009-242700 | | * | 9/2009 |
| JP | 2009-242700 | A | | 10/2009 |
| JP | 2011-029302 | A | | 2/2011 |
| JP | 4927983 | B1 | | 5/2012 |
| JP | 2013-8762 | | * | 1/2013 |
| JP | 2013-8762 | A | | 1/2013 |
| JP | 2013-089688 | A | | 5/2013 |
| WO | 2009/034894 | A1 | | 3/2009 |
| WO | WO2009/034894 | | * | 3/2009 |

* cited by examiner

POWDER MAGNETIC CORE, METHOD OF MANUFACTURING POWDER COMPACT FOR MAGNETIC CORE, DIE AND DIE ASSEMBLY FOR MANUFACTURING POWDER MAGNETIC CORE, AND DIE LUBRICATING COMPOSITION FOR MANUFACTURING POWDER MAGNETIC CORE

CROSS-REFERENCE TO RELATED APPLICATIONS

This application is a U.S. national phase application filed under 35 U.S.C. §371 of International Application No. PCT/JP2014/075345, filed Sep. 25, 2014, designating the United States, which claims priority from Japanese Patent Application No. 2013-201341 and 2013-201344 both filed Sep. 27, 2013, which are hereby incorporated herein by reference in their entirety.

TECHNICAL FIELD

The present invention relates to a powder magnetic core used for soft magnetic components, a method of manufacturing a powder compact for the magnetic core, a die and a die assembly for manufacturing the powder magnetic core, and a die lubricating liquid for manufacturing the powder magnetic core, and relates particularly to a powder magnetic core that is suitable for use in a high frequency range, a method of manufacturing a powder compact for the magnetic core, a die and a die assembly for manufacturing the powder magnetic core, and a die lubricating liquid for manufacturing the powder magnetic core.

BACKGROUND ART

A powder magnetic core obtained by binding soft magnetic powder particles with a binder such as resin is well in material yield of fabrication, as compared to the laminated magnetic core manufactured by using a silicon steel plate or the like, and it has an advantage that reduction of the material cost is possible. It has also another advantage that flexibility in shape is high and it is thus possible to improve the magnetic properties by performing optimal design of the magnetic core shape. In such a powder magnetic core, it is possible to greatly reduce the eddy current loss of the magnetic core by mixing an insulating material such as an organic binder or an inorganic powder into the soft magnetic powder, or by covering the surface of the soft magnetic powder with an electrically insulating film, so as to improve the electrical insulation between the metal powder particles.

From these advantages, the powder magnetic core is used in transformers, reactors, thyristor valves, noise filters and the like, and it is also used for an iron core of motors, a rotor or a yoke of motors in consumer electronics and industrial equipment, and it is further used for a solenoid core (fixed iron core) of an electromagnetic valve which is incorporated in an electronic controlled fuel injection system for diesel engines or gasoline engines, and the like. Thus application to a variety of soft magnetic components is progressing. As compared to the silicon steel plates, the powder magnetic core is capable of reducing the eddy current loss at high frequency range, and application of the powder magnetic core is growing in the utility for the high frequency range such as reactors and the like. Further, the higher frequency of the used frequency band allows miniaturization of the magnetic core itself and reduction of winding number and copper usage in the coil. Therefore, space saving and cost reduction of electronic devices that make use of them can be achieved. Therefore, in recent years, the used band has become higher frequency in many electronic devices and development of a material to adapt to the high frequency is rapidly progressing.

The method of forming the powder magnetic core is roughly classified into: the injection molding method for forming the soft magnetic powder by injecting it together with a raw material of plasticity into the mold that defines the product shape (Patent Literature 1, etc.); and the die compacting method in which a raw material powder containing a soft magnetic powder and a binder is filled in the die hole and compressed to be shaped by upper and lower punches (Patent Literatures 2 and 3, etc.). The product shape of the powder magnetic core is given in the die compacting process, and the forming method to adopt may vary depending on the use of product.

Under the recent demand of miniaturization and weight reduction to various types of equipment for household and industrial as described above, requirement for the powder magnetic core to improve magnetic properties such as magnetic flux density and the like has been increasing. In the powder magnetic core, since the space factor of the soft magnetic powder is proportional to the magnetic flux density, it is necessary to increase the density in order to obtain a powder magnetic core of high magnetic flux density. Therefore, as compared with the injection molding method that requires a large amount of binder, the die compacting method is widely used because it is possible to form to a higher density by decreasing the amount of binder to increase the amount of soft magnetic powder.

In the production of powder magnetic core by die compacting, a raw material powder containing the binder resin and the soft magnetic powder, or, a raw material powder consisting of soft magnetic powder having an insulating film on the surface is filled in a hole of a pressing die of the die assembly and then compressed by upper and lower punches. A specific example of the process for forming a cylindrical green compact for the magnetic core according to the die compacting method as described above is shown in FIG. 1. The die assembly shown in FIG. 1 is equipped with a die 1 having a die hole 1*a* for defining the outer peripheral side surface of the compact by the inner bore surface; a lower punch 2 which defines the lower surface of the compact; and an upper punch 3 which defines the upper surface of the compact. Using such a die assembly, a cavity is formed with the die hole 1*a* of the die 1 and the lower punch 2 and the raw material powder M is filled in the cavity by means of a powder supply device such as a feeder 4 or the like, as shown in FIG. 1(*a*). Then, as shown in FIG. 1(*b*), along with lowering the upper punch 3, the lower punch 2 is relatively raised with respect to the die 1 (in the case of this figure, the die 1 is lowered), so that the raw material powder M filled in the cavity is compressed by the upper punch 3 and the lower punch 2 to form a powder compact C. Thereafter, the upper punch 3 is moved upward to return to the standby position, and, at the same time, the lower punch 2 is relatively raised with respect to the die 1 (in the case of this figure, the die 1 is further lowered) so that the powder compact C is extracted from the die hole 1*a* of the die 1, as shown in FIG. 1(*c*).

CITATION LIST

Patent Literature

Patent Literature 1: Japanese Patent Application Laid-Open No. 2003-209010

Patent Literature 2: Japanese Patent Application Laid-Open No. 2004-342937

Patent Literature 3: Japanese Patent Application Laid-Open No. H05-217777

SUMMARY OF INVENTION

Technical Problem

The iron loss W of the powder magnetic core can be the sum of eddy current loss $W_e$ and hysteresis loss $W_h$, and the eddy current loss $W_e$ and the hysteresis loss $W_h$ can be shown by the following formula 1 and formula 2. Therefore, the iron loss W can be represented as shown in the formula 3 below. In the formulas, f represents the frequency, $B_m$ is the excitation magnetic flux density, ρ is an intrinsic resistance value, t is a thickness of a material, and $k_1$ and $k_2$ are coefficients.

$$W_e=(k_1B_m^2t^2/\rho)f^2 \quad \text{(Formula 1)}$$

$$W_h=k_2B_m^{1.6}f \quad \text{(Formula 2)}$$

$$W=W_e+W_h=(k_1B_m^2t^2/\rho)f^2+k_2B_m^{1.6}f \quad \text{(Formula 3)}$$

As is clear from the formulas 1 to 3, since the eddy current loss $W_e$ increases in proportion to the square of the frequency f, suppression of the eddy current loss $W_e$ is essential in order to apply the powder magnetic core in the reactor or the like used in a high frequency range. To suppress the eddy current loss $W_e$, it is necessary to confine the eddy current in a small area. Therefore, for the powder magnetic core, each of the soft magnetic powder particles are configured to be insulated so as to achieve suppression of eddy current loss $W_e$. Thus, if the particles of the soft magnetic powder are communicated with each other, they conduct through the communicating portion and large eddy current is generated. So, it is important to ensure the insulation of the individual particles of the soft magnetic powder.

In recent years, further improvement in magnetic characteristics have been required, and it has been conducted for improvement of the magnetic flux density to subject to die compacting to the powder compact at a higher pressure so that the space factor of the soft magnetic powder increases. However, when the raw material powder is compacted at a high pressure, the pressure (spring back) at which the powder compact is expanded toward the side becomes large and it tends to expand to the shape shown by the dotted line, as shown in FIG. 2(*a*). If pulling out from the die hole the powder compact on which the spring back acts, the side of the powder compact is pressed strongly against the inner surface of the die hole while the powder compact is in sliding contact with the die hole. Thus the side surface of the powder compact after extracting from the die hole has caused the plastic flow in its surface portion, as shown in FIG. 2(*b*). Then the insulating film formed on the surface of the soft magnetic powder particles is broken, and the soft magnetic powder particles also become a state of being conductive to each other to increase the eddy currents. In the case where the magnetic flux is generated in a closed magnetic circuit, the eddy current circulates around the magnetic flux in the annular state perpendicular to the direction of the magnetic flux. Although the increase in eddy current can be originally suppressed by the insulation subjected to each of the individual soft magnetic powder particles, the eddy current is significantly increase when the insulation is broken at the sliding surface and the outer circumferential surface of the powder compact becomes conductive. Moreover, especially in the case of reactor, since the magnetic path is constituted by combining the cores with each other, magnetic flux leakage (fringing) from the combined surfaces occurs considerably. If the leaking magnetic flux invades again in the direction perpendicular to the conductive sliding surface, the eddy current is further increased. Therefore, insulation maintenance of the sliding contact surface is one of the very important technical requirements for the core of the high frequency applications. Among the materials for powder magnetic cores, low alloyed materials, including pure iron, easily cause, in particular, plastic flow because of the soft base, and the base has a low specific resistance in their material systems. Therefore, conduction due to plastic flow must be reliably prevented.

In addition, the induction current generated in the powder magnetic core flows concentrated in the surface as the frequency becomes higher. Therefore, if the powder magnetic core in which the insulating film in the soft magnetic powder particles has been destroyed by the plastic flow caused in the surface layer portion as described above is used in high frequency applications such as the reactor, induced current flows concentrated in the surface layer portion where the insulating film is destroyed to conduct the soft magnetic powder particles, and the eddy current loss $W_e$ becomes increasingly large, resulting in increase of iron loss W.

In the powder magnetic core having a surface layer portion in which the insulating film is destroyed and the soft magnetic powder particles are conductive to each other as mentioned above, the portion where the magnetic metal powder particles are in direct contact with each other may be removed by stripping the surface portion of the powder compact as in Patent Literature 3, and the surface layer of the powder magnetic core becomes a well state that the soft magnetic powder particles are coated with the insulating film. However, such removal processing of the surface requires a special technique that is different from those in ordinary cutting, leading to increase of the manufacturing cost. Therefore, a technology has been demanded that plastic flow of the soft magnetic powder is suppressed in the surface layer portion of the powder compact for a magnetic core which is compacted and extracted from the die hole, and that allows to obtain a powder compact in a well state without breakdown of the insulating film.

An object of the present invention is to solve the above problems and to provide a powder magnetic core in which the insulating film of the soft magnetic powder particle surfaces is not destroyed in the surface layer to show a well insulating state, and which the increase in eddy current loss $W_e$ and iron loss W is suppressed even when used in high frequency applications.

It is also an object to provide a method of manufacturing a powder compact for a magnetic core where conduction formation by the plastic flow is suppressed at the surface portion of the powder compact for a magnetic core that is extruded from the die hole, even by die compacting at a high density using a high pressure.

Moreover, it is an object to provide a die and a die assembly for manufacturing a powder magnetic core which are capable of suppressing the conduction formation by plastic flow in the surface layer of the powder compact when pushing the powder compact out of the die hole in the manufacture of a compact for a magnetic core, and to provide a lubricating liquid of the die for manufacturing the powder magnetic core.

Technical Solution

In order to solve the above problems, according to an aspect of the present invention, the subject matter of the powder magnetic core resides in that a powder magnetic core is configured of a powder compact that a soft magnetic powder is compacted at a density ratio of 91% or more than 91%, the powder compact comprising, on an extrusion-sliding surface: a surface layer portion having a structure where molybdenum disulfide particles are interposed between particles of the soft magnetic powder. It is preferred if insulating ceramic particles are also interposed between the particles of the soft magnetic powder in the structure of the surface layer portion.

In the powder magnetic core, the insulating ceramic particles and molybdenum disulfide particles, with interposing between the particles of the soft magnetic powder, support the soft magnetic power particles to suppress deformation and plastic flow, so as to prevent the insulation breakdown of the surface of the soft magnetic powder particles. Moreover, the specific resistance of the surface layer portion on the side surface of the compact increases due to the insulating property of the insulating ceramic particles themselves. Therefore, when it is used as a powder magnetic core for high frequency at which the induced current flows concentrated onto the surface of the powder magnetic core, it is excellent in reducing the eddy current loss $W_e$.

When observing the surface state, in the side surface of the powder compact, the adjacent soft magnetic powder particles are preferably in a discrete state by the intervention of the molybdenum disulfide particles and/or insulating ceramic particles. Moreover, an area ratio of the molybdenum disulfide particles existing in a portion (gap) where the soft magnetic powder is absent is preferably 30% or more than 30% in the surface observation of the side surface. In the case of using the insulating ceramic particles, the total area ratio of the molybdenum disulfide particles and the insulating ceramic particles is preferably 30% or more than 30%. It is appropriate that the molybdenum disulfide particles have a particle size of 100 to 1,000 nm and the insulating ceramic particles have a particle size of 50 to 1,000 nm. It is further preferred that the insulating ceramic particles have a surface formed with an organic coating of a Si-containing compound and/or an Al-containing compound.

Moreover, according to an aspect of the present invention, the method of manufacturing a powder magnetic core for a magnetic core comprises: filling a soft magnetic powder in a die hole of a die for compaction; pressing the soft magnetic powder to form a powder compact so that a density ratio of the soft magnetic powder is 91% or more than 91%; and extruding the powder compact from the die hole, and the subject matter of the method of manufacturing a powder magnetic core for a magnetic core resides in that, before the charging the soft magnetic powder, a lubricating coating containing a lubricating oil and molybdenum disulfide particles is formed on an inner surface of the die hole that makes sliding contact with the powder compact at the extruding. It is preferred that the lubricating coating further contains insulating ceramic particles.

The composition ratio of the molybdenum disulfide particles in the lubricating coating is preferably 30 to 80% by mass. In the case of using the insulating ceramic particles, the lubricating coating preferably contains the insulating ceramic particles of 1 to 10% by mass, molybdenum disulfide particles of 30 to 80% by mass, and the balance lubricating oil.

In the manufacturing method, the lubricating coating is formed by applying a lubricating composition containing the lubricating oil and molybdenum disulfide particles (and insulating ceramic particles) to the inner surface of the die hole, and a raw material containing a soft magnetic powder is charged into the die hole. Thereby the raw material powder is in a state of contacting with the die hole surface via the liquid lubricating oil and molybdenum disulfide particles (and the insulating ceramic particles). In this state, a part of the lubricating oil permeates by capillary force into the gap between the charged raw material powder particles. Along with this, molybdenum disulfide particles (and the insulating ceramic particles) are also partially introduced from the inner surface of the die hole into the gap between the raw material powder particles and are sandwiched between the raw material powder particles.

When starting the die compacting in this state, the lubricating oil is extruded from the gap between the powder particles to the clearance between the powder compact and the inner surface of the die hole, along with the decrease of the gap between the raw material powder particles. However, the solid of molybdenum disulfide particles (and the insulating ceramic particles) remains caught between the soft magnetic powder particles, while the pressing of the compact is completed. The side surface of the powder compact for magnetic core after the completion of compaction, that is, the surface that contacts the inner surface of the die hole comes into the surface state that the molybdenum disulfide particles (and the insulating ceramic particles) are dispersed, and the molybdenum disulfide particles (and the insulating ceramic particles) are interposed between the particles of the soft magnetic powder in the surface layer portion of the side surface. Between the inner surface of the die hole and the compact, the lubricating oil and the molybdenum disulfide exist.

When performing extrusion of the compact in this state, molybdenum disulfide particles dispersed between the particles of the soft magnetic powder support the soft magnetic powder against the frictional resistance by the extrusion, and they suppress the deformation and plastic flow as well as relieve the stress caused by the frictional resistance applied to the soft magnetic powder particles, by cleavage and lubricating properties of the molybdenum disulfide. For the stress that exceeds the level of relaxation by the cleavage of molybdenum sulfide particles, the insulating ceramic particles which are harder than the molybdenum disulfide particles support the soft magnetic particles against the stress, and, for excessive stress, the stress of the soft magnetic powder particles is released by brittle fracture of the insulating ceramic particles. Further, the frictional resistance between the inner surface of the die hole and the side surface of the powder compact making the sliding contact with it is reduced to facilitate the extracting of the compact from the die hole, thereby it becomes possible to obtain a powder magnetic core having a good side surface in which the insulating coating is not destroyed.

In the manufacturing method of a powder compact for a magnetic core of the present invention, the lubricating coating formed on the inner surface of the die hole preferably has a thickness of 0.1 to 20 μm. The insulating ceramic particles preferably have a particle size of 50 to 1,000 nm, and the molybdenum disulfide particles preferably have a particle size of 100 to 1,000 nm. Moreover, it is further preferred that the insulating ceramic particles have a surface formed with an organic coating of a Si-containing compound and/or an Al-containing compound. The lubricating oil has preferably a kinematic viscosity of 1,000 to 100,000=$^2$/s.

Moreover, according to an aspect of the present invention, the subject matter of the die for manufacturing a powder magnetic core resides in comprising: a die hole for compacting a raw material powder to form a powder compact; and a lubricating coating provided on an inner surface of the die hole that makes sliding contact with the formed powder compact at extrusion of the formed powder compact, the lubricating coating containing an lubricating oil and molybdenum disulfide particles.

Further, according to an aspect of the present invention, the subject matter of the die assembly for manufacturing a powder magnetic core resides in comprising: a die for manufacturing a powder magnetic core as described above; and upper and lower punches for pressing the raw material powder in the die hole.

Furthermore, according to an aspect of the present invention, the subject matter of the lubricating composition of a die for manufacturing a powder magnetic core resides in comprising: a lubricating oil; and molybdenum disulfide particles, and it is preferred to further comprise insulating ceramic particles.

Advantageous Effects of Invention

According to the present invention, the powder magnetic core has a surface layer portion on the side surface of the powder magnetic core, formed by the inner surface of the die hole of the die, where molybdenum disulfide particles (and insulating ceramic particles) are dispersed between the soft magnetic powder particles, thereby plastic flow of the soft magnetic powder is suppressed from being caused by the extraction after die compacting and it is possible to prevent the insulating film on the soft magnetic powder particle surfaces from being broken. Therefore, a powder magnetic core in which the eddy current loss $W_e$ is suppressed to a low level can be manufactured and a good product even in high frequency application can be provided. Also, the specific resistance in the surface layer on the side of the powder magnetic core is increased by the insulating property of the insulating ceramic particles themselves dispersed between the soft magnetic powder particles in the surface layer portion of the side surface of the powder magnetic core, and it is possible to suppress an increase in eddy current loss $W_e$ even if the induced current flows concentrated on the surface of the powder magnetic core when used as a powder magnetic core for high frequency. Thus it is possible to provide a powder magnetic core which exhibits excellent performance also in high frequency applications.

Further, according to the present invention, it is possible to effectively suppress the plastic flow at the side surface of the powder compact extruded from the die hole, by forming a lubricating coating which contains molybdenum disulfide particles (and insulating ceramic particles) on the inner surface of the die hole, and a powder compact retaining good insulating properties is obtained without breakdown of the insulating coating on the soft magnetic powder particle surface in the surface layer. Thus a manufacturing method of a powder compact for a magnetic core that is excellent in economy is provided so that a powder compact of high quality is obtained by a simple technique. Moreover, since the powder compact for a magnetic core obtained by the manufacturing method of the present invention has a surface structure in which molybdenum disulfide particles (and the insulating ceramic particles) are dispersed between the soft magnetic powder particles and has a surface portion having improved insulating properties on the side surface, a powder compact for a magnetic core that exhibits excellent properties even in high frequency application is accomplished and a manufacturing method of a powder compact for a magnetic core of high applicability is provided.

MODE FOR CARRYING OUT THE INVENTION

Figure 1:
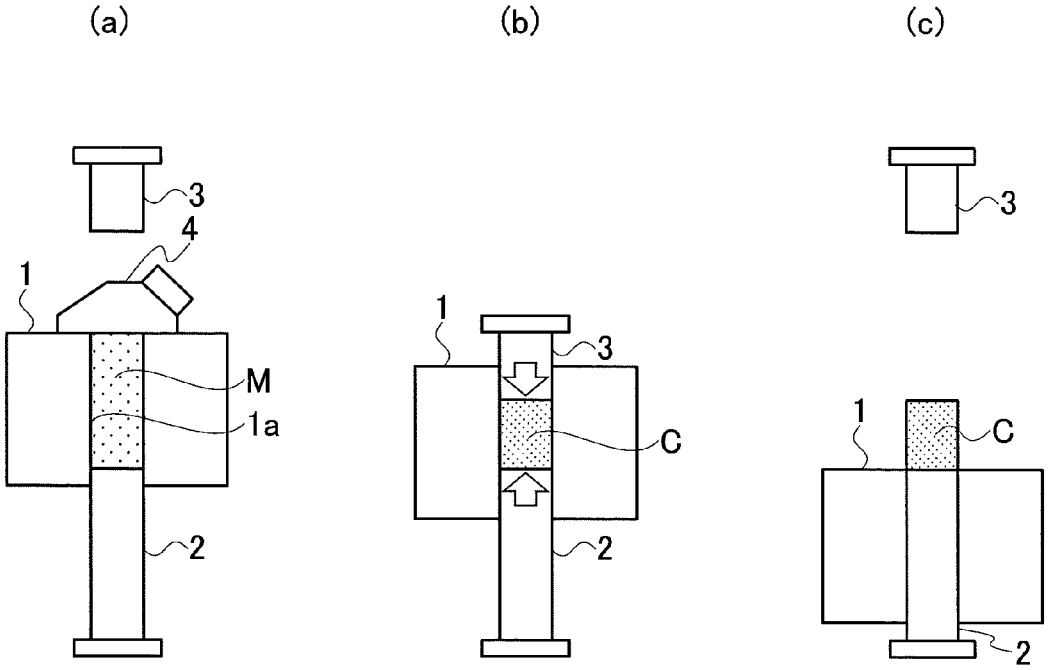
FIG. 1 It is schematic illustration explaining a forming process according to the die compacting method.
Figure 2:
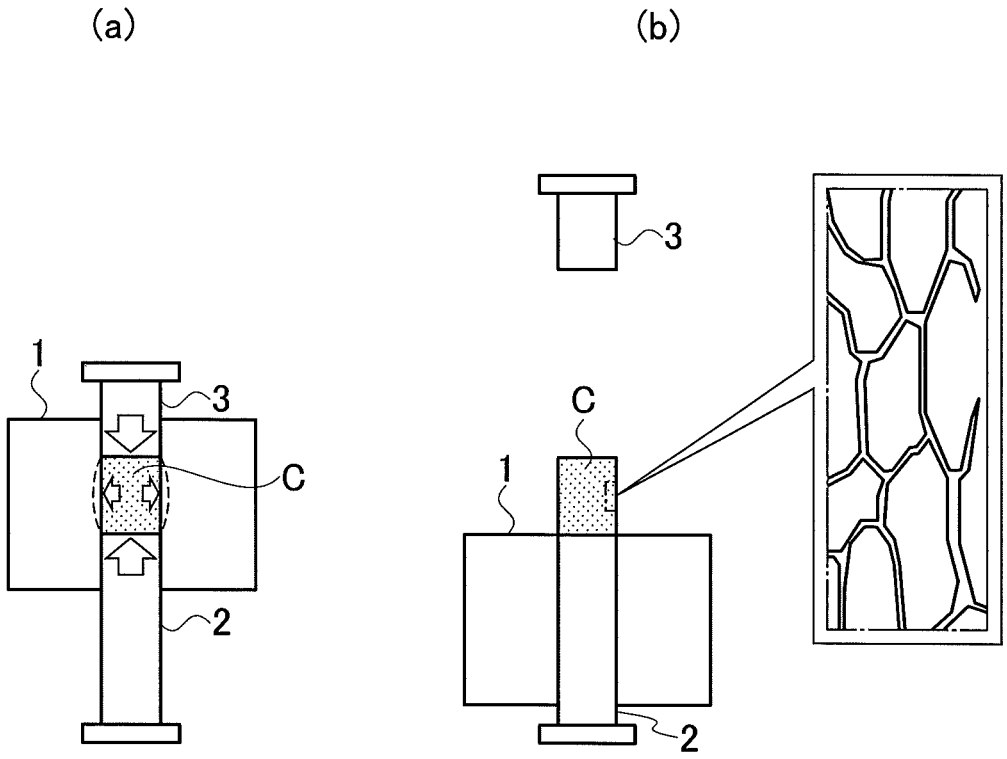
FIG. 2 It is schematic illustration explaining a state of the powder compact for a magnetic core when the raw material containing soft magnetic powder is pressed at high pressure.

As shown in FIG. 1 and FIG. 2, in pressing of the powder compact by die compacting, the side surface of the powder compact formed by the inner surface of the die hole is made to the extrusion-sliding surface that makes sliding contact with the inner surface of the die hole when extruding the powder compact from the die hole. At a higher density the powder compact is formed, the larger spring back acts to press the powder compact to the inner surface of the die hole. Thus the frictional resistance acting between the inner surface of the die hole and the side surface of the powder compact becomes large while extruding the powder compact from the die hole, and plastic flow occurs in the surface layer portion on the side surface of the powder compact. In general use, this may be recognized as a preferable phenomenon to beautify the appearance by smoothing the side of the powder compact. However, as the powder magnetic core, it is the phenomenon leading to dielectric breakdown and increase in the iron loss in the surface layer portion, and thus there is a necessity to prevent plastic flow caused by frictional resistance. To reduce the frictional resistance on the sliding contact surface, a die lubricant is normally used. However, in the forming of a high-density powder compact, it is still difficult to suppress the plastic flow in the surface layer with use of a common die lubricant since the frictional resistance becomes very large.

In the present invention, a lubricating coating containing a lubricating oil and molybdenum disulfide particles is formed on the inner surface of the die hole of the pressing die, and die compacting of the soft magnetic powder is performed using the die hole with the lubricating coating. In the powder compact pressed to high density in such a die hole, plastic flow of the soft magnetic powder particles on the side surface of the powder compact is suppressed, despite the side surface of the powder compact and the inner surface of the die hole are in the sliding contact while pushed out from the die hole. When the lubricating coating contains insulating ceramic particles, its effectiveness is more pronounced. The reason for this can be considered as follows. When the soft magnetic powder is pressed, molybdenum disulfide particles and ceramic particles contained in the lubricating coating are pushed into between the soft magnetic powder particles which are pressed against the die hole inner surface. Therefore, the side surface of the powder compact formed in the die hole has a surface layer portion in the structure where molybdenum disulfide particles and/or ceramic particles are interposed between the soft magnetic powder particles. When extruding such a powder compact from the die hole, the lubricating oil contained in the lubricating coating works to reduce the static frictional force and kinetic frictional force to some extent to facilitate extrusion. At the same time, molybdenum disulfide particles and/or ceramic particles interposed between the soft magnetic powder particles support the soft magnetic powder particles to inhibit their deformation and plastic flow. In the meantime, if the stress applied to the soft magnetic powder particles by the frictional resistance exceeds a certain level, molybdenum disulfide particles themselves are cleaved and broken. In the case where the insulating ceramic particles are also contained, they stand against a stress that exceeds the hardness of molybdenum disulfide, and then the insulating ceramic particles themselves are broken. Through the breaking of those particles, the stress to be applied to the soft magnetic powder particles is reduced. The molybdenum disulfide particles and ceramic particles are gradually broken in accordance with the frictional resistance during the extrusion. Since the broken molybdenum disulfide particles and/or ceramic particles are interposed between the soft magnetic powder particles, the soft magnetic powder particles are prevented from close contact or binding in the particles themselves even if they are deformed. In other words, firstly, molybdenum disulfide particles and ceramic particles that have a moderate hardness are effective to enter between the soft magnetic powder particles and support the soft magnetic powder particles in the surface layer portion of the side of the powder compact, thereby plastic flow of the soft magnetic powder particles is suppressed against the stress due to the frictional resistance and the soft magnetic powder particles can be prevented from contacting and bonding between them. Secondly, molybdenum disulfide particles and ceramic particles that exhibit a moderate brittleness or cleavage are effective to disperse and alleviate the stress due to the frictional resistance during extrusion, thereby deformation and plastic flow of the soft magnetic powder particles is suppressed. Further, in the third, molybdenum disulfide particles and ceramic particles that are insulating materials secure insulation between the soft magnetic powder particles in the surface layer portion on the side surface of the powder compact, and the ceramic particles are effective to enhance rather. In the fourth, the lubricating coating comprises a lubricating oil of liquid state and molybdenum disulfide particles that are solid lubricant. While the lubricating oil is particularly effective in reducing the dynamic friction, the solid lubricant is particularly effective in reducing static friction. Therefore, it is possible with the both components to reduce the overall friction that occurs between the inner surface of the die hole and the side surface of the powder compact.

The powder compact pressed using a die hole on which the lubricating coating as described above is formed has a structure in which molybdenum disulfide particles are sandwiched and interposed between the soft magnetic powder particles in the surface layer portion of the side surface (i.e., the extrusion-sliding surface), and preferably has a structure in which the insulating ceramic particles are also interposed between the soft magnetic powder particles. Accordingly, if the side surface of such a powder compact is subjected to the surface observation according to, for example, electron probe micro-analysis (EPMA) or the like, it is possible to confirm the state that molybdenum disulfide particles and/or the insulating ceramic particles are dispersed in the gap between the soft magnetic powder particles in the SEM image and the component map. In the case where a soft magnetic powder having an insulating coating formed on the particle surface thereof is used as the raw material powder for pressing, breakdown of the insulating coating on the surface of the soft magnetic powder is suppressed and a powder compact is formed in a good state in which the soft magnetic powder is favorably covered with the insulating coating. In the case of pressing a mixture of the soft magnetic powder and a resin binder, if using a conventional die lubricant, it is difficult to suppress the plastic flow of soft magnetic powder particles due to the frictional resistance during the extrusion. However, if using the die hole formed with a lubricating coating containing molybdenum disulfide (and the insulating ceramic particles) according to the present invention, molybdenum disulfide (and the insulating ceramic particles) is similarly pushed between the soft magnetic powder particles at the side surface of the compact to be formed, and a surface layer portion in which molybdenum disulfide (and the insulating ceramic particles) is dispersed in the gap between the soft magnetic powder particles is to be formed. When using the powder magnetic core having such a good surface under high frequency, since the insulation at the surface of the powder magnetic core is ensured as described above, the eddy current loss $W_e$ can be effectively suppressed even if the induced current flows concentrated onto the surface of the powder magnetic core.

When the amount of molybdenum disulfide particles (and/or insulating ceramic particles) contained in the lubricating coating formed on the inner surface of the die hole increases, excess portion of molybdenum disulfide particles (and/or insulating ceramic particles) that cannot be pushed into between the soft magnetic powder particles on the side surface of the compact is located on the side surface of the compact, thereby the surface layer portion of the compact is covered with the molybdenum disulfide particles (and/or insulating ceramic particles). In the present invention, the side surface of the powder compact may be covered with at least one of the molybdenum disulfide particles and the insulating ceramic particles as described above. Excess molybdenum disulfide particles (and/or insulating ceramic particles) covering the side surface of the powder compact never becomes an obstacle in the use of the powder magnetic core, and they can be removed if necessary. As long as the formulation balance of the molybdenum disulfide particles (and the insulating ceramic particles) with the lubricating oil in the lubricating coating and the thickness of the coating are appropriate, the molybdenum disulfide particles (and/or ceramic particles) enter into between the soft magnetic powder particles to suppress plastic flow suitably. Therefore, an excess amount of molybdenum disulfide particles (and/or insulating ceramic particles) is allowed, so long as it does not adversely affect the dimensional accuracy of the powder compact.

Moreover, the presence of the insulating ceramic particles dispersed in the gap between the soft magnetic powder particles improves the insulation between the soft magnetic powder particles, and the side surface of the powder magnetic core has a surface layer portion where the specific resistance is higher than that of the inner portion because the insulating ceramic particles introduced from the lubricating coating do not reach the inner portion of the powder compact. This surface layer portion having a higher specific resistance is particularly effective to suppress the eddy current loss $W_e$ in a state where the induced current flows concentrated to the surface of the powder magnetic core under a high frequency environment.

In the conventional manufacturing method, plastic flow of the soft magnetic powder particles by the frictional resistance during the extrusion from the die hole takes place most strongly at the outermost side surface of the powder compact, and the influence of frictional resistance extends, generally, to the area of up to about 20 μm of the depth from the outermost surface. However, if using a die hole in which the lubricating coating containing molybdenum disulfide particles (and insulating ceramic particles) is formed on the inner surface according to the present invention, molybdenum disulfide particles (and the insulating ceramic particles) support the soft magnetic powder particles at the surface of the side of the powder compact, thereby plastic flow is suppressed at the surface. Along with this, the influence of the frictional resistance can also be suppressed from extending to the inside. Therefore, if the depth of the surface layer portion which molybdenum disulfide particles (and the insulating ceramic particles) are dispersed in the side of the powder magnetic core is about 1 to 100 μm from the surface, the effect of suppressing the plastic flow of the soft magnetic powder particles is good, and it is sufficient if the depth is up to about 1 mm at the maximum. Further, if the pressing is performed by using a die hole which the lubricating coating as described above is formed on the inner surface, such a surface layer portion that the molybdenum disulfide particles (and the insulating ceramic particles) are dispersed is formed on the side surface of the powder compact. In the powder magnetic core under high-frequency environment, although the depth of the surface region to which the induced current is concentrated depends on the frequency, it is sufficiently compatible in at least about 1 kHz to 50 kHz frequency, by the increase of specific resistance value by means of the insulating ceramic particles at the depth of the surface layer portion as described above.

Since the plastic flow of the soft magnetic powder particles in the powder compact occurs on the side surface of the powder compact, the above-described lubricating coating may be formed on at least the inner surface of the die hole, and the surface layer portion which molybdenum disulfide particles (and the insulating ceramic particles) are dispersed between the soft magnetic powder particles may be formed in at least the side surface of the powder compact. Therefore, it is not necessary to form the lubricating coating having the above-described composition on the upper and lower punches which form the upper and lower surfaces of the powder compact. However, the lubricating coating containing molybdenum disulfide and/or the insulating ceramic particles may be formed on the upper and lower punches to form the powder compact. In this case, the surface layer portion which molybdenum disulfide and/or the insulating ceramic particles are dispersed is also formed on the upper and lower surfaces of the powder compact, and the soft magnetic powder particles at the outermost surface of the upper and lower surfaces are prevented from being collapsed and contacting with each other.

In the surface layer portion of the side surface of the powder compact described above, molybdenum disulfide particles and the insulating ceramic particles surround the soft magnetic powder particles to restrain them, and the state of the adjacent soft magnetic powder particles are discontinuous from each other so that conduction between the adjacent soft magnetic powder particles can be completely prevented. That is, the higher this discontinuity, the more the resistivity of this region is improved to be preferable as the powder magnetic core. Also, restraint of the soft magnetic powder particles becomes strong and the effect of preventing plastic deformation increases.

In the preferred powder compact for a powder magnetic core, the surface layer portion which molybdenum disulfide particles (and the insulating ceramic particles) are interposed between the soft magnetic powder particles can be confirmed in the surface observation of side surface based on the component map by EPMA. When using the insulating ceramic particles, it is important to consider the affinity to the soft magnetic powder of the molybdenum disulfide particles and the insulating ceramic particles. If there are no difference in the affinity to the soft magnetic powder between the molybdenum disulfide particles and the insulating ceramic particles, they enter equally between the soft magnetic powder particles during the compacting and they are mixed in the gap between the soft magnetic powder particles also in the component map. Therefore, the state of the surface layer can be evaluated by the area ratio of any of the molybdenum disulfide particles or the insulating ceramic particles. In contrast, if the affinity to the soft magnetic powder is different between the insulating ceramic particles and the molybdenum disulfide particles, the particles having high affinity cover the soft magnetic powder particles, and the particles having low affinity exist around it. Accordingly, in the component map, the particles of low affinity are unevenly distributed in the region corresponding to the gap between the soft magnetic powder particles, and the high affinity particles are unevenly distributed in the area of the soft magnetic powder and in the neighboring area surrounding it. Therefore, it is regarded as more appropriate to evaluate on the basis of the area ratio of the particles having a low affinity to the soft magnetic powder, in order to evaluate the intervening particles between the soft magnetic powder particles in the surface layer of the side surface of the powder compact. Such affinity difference is largely attributed to the kind of the insulating coating formed on the particle surface of the soft magnetic powder, and the presence or absence and the kind of surface modification that is applied to the insulating ceramic particles.

In view of the above, the area ratio of the molybdenum disulfide particles and/or insulating ceramic particles present in the portion where the soft magnetic powder particles are not present (i.e., a percentage in the captured image area of the area of a component of the molybdenum disulfide particles and/or the insulating ceramic particles detected in the region where the soft magnetic powder components are not detected) may be about 30% or more. If the area ratio of the molybdenum disulfide particles and/or the insulating ceramic particles at the surface observation of the side surface is less than 30%, the effect of the intervening particles to prevent plastic deformation of the soft magnetic powder particles becomes insufficient, plastic flow of the soft magnetic powder has occurred and there is a possibility that the conduction of the adjacent soft magnetic powder particles occurs. It should be noted that the space factor of the soft magnetic powder on the surface is reduced in accordance with increase in the area ratio of the molybdenum disulfide particles and/or the insulating ceramic particles on the surface of the side surface of the powder compact. However, this is the state of only the surface of the powder compact, and the space factor of the soft magnetic powder in the inner portion deeper than the surface layer portion of the powder compact is possibly increased up to the desired space factor in accordance with the degree of compression. Therefore, there is no particular upper limit with respect to the area ratio of the molybdenum disulfide particles and/or insulating ceramic particles in the outermost surface of the side surface of the powder compact, and the side surface of the compact may be completely covered with the molybdenum disulfide particles and/or the insulating ceramic particles, as described above. In the case where the side surface of the powder compact is covered with a thin layer of molybdenum disulfide particles and/or insulating ceramic particles, if the thin layer is removed and the surface observation of the surface layer is then performed, the area ratio of the insulating ceramic particles and the molybdenum disulfide particles interposed between the soft magnetic powder particles is generally in the range of about 65% or less.

As described above, since the molybdenum disulfide particles and the insulating ceramic particles are introduced from the lubricating coating formed on the inner surface of the die hole, they exist only on the surface layer portion (i.e. the surface and near the surface) on the side surface of the powder compact formed by the inner surface of the die hole. Such a structure cannot be obtained by compaction of the raw material powder prepared by blending molybdenum disulfide particles and/or insulating ceramic particles into the soft magnetic powder. If compaction is performed to the soft magnetic powder into which molybdenum disulfide particles and/or insulating ceramic particles have been added, the raw material powder is lowered in flowability and filling easiness of the raw material powder into the cavity is decreased. Further, compressibility of the raw material itself is lowered, so that it is difficult to form the powder magnetic core at a high density. Even if it is forced to be compacted to a high density, the space factor of the soft magnetic powder in the powder magnetic core is reduced by the present of molybdenum disulfide particles and/or insulating ceramic particles distributed throughout the power compact, so that the magnetic flux density is decreased. Therefore, in the configuration of the present invention to disperse the molybdenum disulfide particles (and the insulating ceramic particles) only in the surface layer portion on the side surface of the powder compact by forming a lubricating coating on the inner surface of the die hole, the powder compact can be constructed so that the insulating ceramic particles are not dispersed in the inner portion of the powder compact. Thus it is highly advantageous in high density compaction.

The raw materials of the powder compact for the magnetic core according to the present invention will be described. In the following description, it is intended for the particle size of powder to mean the average particle size by a laser diffraction method for the powder in μm unit, and to mean the average particle diameter determined by TEM observation for the powder in nm unit.

For the soft magnetic powder, any of the soft powders and hard powders may be used, and iron-based metal powders including pure iron powder and iron alloy powders such as Fe—Si alloy powder, Fe—Al alloy powder, permalloy powder, sendust powder, permendur powder, soft ferrite powder, amorphous magnetic alloy powder, nano-crystal magnetic alloy powder and the like can be used. In terms of height of the magnetic flux density and moldable property or the like, pure iron powder is excellent. In order to obtain a high density powder magnetic core which is suitable for high frequency, a particle size of the soft magnetic powder is preferably about 1 to 300 μm. The present invention is particularly effective when using a soft magnetic powder that is soft and easy to cause plastic deformation during the die compacting, and it is most effective for iron powder and iron-based low-alloyed powders in which an addition amount of alloying elements such as Si, Al and the like is 3% or less. However, it is also effective in the case of using a soft magnetic powder which is hard and scarcely occurs plastic deformation in the extrusion after compaction, and there is an effect that, when the soft magnetic powder particles are crushed in the compaction, molybdenum disulfide particles or insulating ceramic particles enter between the broken pieces of the soft magnetic powder particles to form an insulation between the broken pieces. In addition, even in the case of a soft magnetic powder which is difficult to plastically deform but is not very hard as to be crushed, the effect of improving the specific resistance on the side surface of the powder compact can be obtained by the molybdenum disulfide particles or the insulating ceramic particles dispersed between the soft magnetic powder particles on the side surface of the powder compact. Molybdenum disulfide particles interposed between the soft magnetic powder particles exhibit the lubricity against the inner surface of the die hole to reduce in particular the static friction, and they effects to facilitate the extrusion of the compact.

Further, in order to ensure the insulation of the individual soft magnetic powder particles, it is preferable to coat the surface of the soft magnetic powder particles with an insulating film. In this case, inorganic insulating film such as phosphoric acid-based chemical conversion film and the like, and silicone resin film and the like are preferable. The insulating film of the particle surface as described above may be formed by chemical conversion treatment or contact coating according to the conventional methods, and reference may be made to the description of the publications of, for example, Japanese Patent No. 4044591 and Japanese Patent No. 4927983. Alternatively, a suitable one may be selected from commercially available powder products, and, powder products such as Somaloy 110i (5P) manufactured by Höganäs AB Co., MH20D manufactured by Kobe Steel Ltd., and the like are given for example.

It should be noted that, if the insulation of the individual soft magnetic powder particles is ensured by blending a binder such as resin to the soft magnetic powder, the insulating film may not be formed on the particle surface of the soft magnetic powder. In this case, a powder compact in which the respective soft magnetic powder particles are bounded with the binder such a resin is obtained as for the powder compact for magnetic core, and, if the amount of the binder is increased, the ratio of the soft magnetic powder is correspondingly reduced and the space factor of the soft magnetic powder in the powder compact is decreased, resulting in decrease in the magnetic flux density of the powder magnetic core. Therefore, the amount of binder should be adjusted to 2% by mass or less of the powder compact.

Next, a description will be given for the raw materials of the lubricating coating to be formed on the inner surface of die hole of the pressing die according to the present invention.

The particles introduced into the lubricating coating are those for preventing plastic flow of the soft magnetic powder and performing electrical isolation of the soft magnetic powder, by being dispersed between the soft magnetic powder particles. Therefore, it is required that the particles have an appropriate hardness and they exhibit no conductivity (insulating). To this end, molybdenum disulfide and insulating ceramic particles are preferred.

Molybdenum disulfide satisfies the hardness and conductivity requirements of the particles introduced into the lubricating coating, and it prevents the plastic flow of the soft magnetic powder and serves to maintain the electrical insulation of the soft magnetic powder. Further, molybdenum disulfide particles act as a solid lubricant and it is a high lubricity material having stress relaxation ability. The hardness of molybdenum disulfide (Vickers hardness: about 500 to 900 HV) is in the same degree as those of ceramics of relatively low hardness, and it is possible to suppress the plastic flow by supporting the soft magnetic powder particles against the stress due to the frictional resistance. Since the breaking strain is zero, it causes its own cleavage to the excessive stress, so as to alleviate the stress on the soft magnetic powder particles. If it is used together with insulating ceramic particles, it is generally cleaved in advance of the insulating ceramic particles when subjected to the stress.

If the molybdenum disulfide particles are coarse, the amount of particles necessary for ensuring the insulation of the soft magnetic powder becomes large and, at the same time, the mass of the individual molybdenum disulfide particles increases, thereby they tend to fall off from the coating formed on the inner surface of die hole. Therefore, it is preferable to use molybdenum disulfide particles whose size is such that the maximum particle diameter is 1,000 nm or less. On the other hand, since excessively fine molybdenum disulfide particles are difficult in their production and handling, it is preferable to use such a powder that the maximum particle diameter is 10 nm or more.

As the insulating ceramic particles, ceramic particles of oxide type, nitride type, carbide type or the like can be used, and examples of the oxide-type ceramic particles include aluminum oxide ($Al_2O_3$), titanium dioxide ($TiO_2$), silicon dioxide ($SiO_2$), magnesium oxide (MgO), zirconium dioxide ($ZrO_2$), steatite ($MgO.SiO_2$), zircon ($ZrSiO_4$), ferrite ($M^{2+}O.Fe_2O_3$), mullite ($3Al_2O_3.2SiO_2$), forsterite ($2MgO.SiO_2$), yttria ($Y_2O_3$), and the like. Examples of the nitride-type ceramic particles include powders of aluminum nitride (AlN), titanium nitride (TiN), silicon nitride ($Si_3N_4$), and the like. Examples of the carbide-type ceramic particles include powders of titanium carbide (TiC), tungsten carbide (WC) and the like. In addition to the above, oxynitride ceramic particles such as sialon (Si—Al—O—N-based compound), carbonitride ceramic particles such as titanium carbon nitride (TiCN), cordierite particles, machinable ceramics particles ($SiO_2.Al_2O_3$, AlN.BN), and the like are also usable. The ceramics as described above exhibit the yield stress at a value of approximately 2,000 to 10,000 MPa, that is greater than low-alloyed steels of 200 to 2,000 MPa, and they can thus support the soft magnetic powder particles against the stress due to the frictional resistance and suppress the plastic flow. Further, since they have appropriate hardness of about 200 to 1,800 (Vickers hardness) and breaking strain is zero, they cause their own rupture by brittle fracture to excessive stress, so as to disperse and relax the stress applied to the soft magnetic powder particles. For the insulating ceramic particles, fine ones are suitable as will be described later. However, since a fine powder has an increased risk of dust explosion, it is preferred in this respect to use an oxide-type insulating ceramic in a state of being sufficiently oxidized and less risk of dust explosion. Moreover, it is also possible to select a plurality of different types of ceramic particles from the ceramic particle as described above and mix them to use as the insulating ceramic particles.

If the molybdenum disulfide particles are coarse, the amount of particles necessary for ensuring the insulation of the soft magnetic powder becomes large and, at the same time, the mass of the individual molybdenum disulfide particles increases, thereby they tend to fall off from the coating formed on the inner surface of die hole. Also when the compaction is completed in the state where the coarse insulating ceramic particles are present between the inner surface of the die hole and the soft magnetic powder filled therein, if the powder compact is to be pushed out of the die hole, the coarse insulting ceramic particles abrade the inner surface of the die hole and allow the wear to proceed. In addition, stress relaxation by the self-rupture becomes difficult to act effectively. Therefore, deformation of the soft magnetic powder particles cannot be sufficiently suppressed. Further, in the case where the surface of the soft magnetic powder is covered with the insulating film, there is a possibility that destruction of the insulating film occurs. In addition, there is a possibility that wear debris caused by wear of the die and the soft magnetic powder adheres to the surface of the powder compact and makes a condition where the adjacent soft magnetic powder particles are joined to lead the breakdown between the soft magnetic powder particles. Therefore, it is preferred to use the insulating ceramic particles having such a size that the maximum particle diameter is 1,000 nm or less. On the other hand, since excessively fine insulating ceramic particles are difficult in their production and handling, it is preferable to use such a powder that the maximum particle diameter is 50 nm or more.

A powder compact having, on the side surface, the surface layer in which the molybdenum disulfide particles (and the insulating ceramic particles) are dispersed is possibly manufactured as described below.

First, in the manufacturing method of a powder compact for a magnetic core of the present invention, a lubricating composition containing the molybdenum disulfide particles (and the insulating ceramic particles) and the lubricating oil is applied to the surface defining the cavity of the die assembly, in particular to the inner surface of the die hole, to form a lubricating coating, and then a raw material powder containing the soft magnetic powder is charged into the cavity of the die assembly. At this time, the raw material powder filled in the cavity is in contact with the die hole through the lubricating oil in which the molybdenum disulfide particles (and the insulating ceramic particles) are dispersed.

Subsequently, the raw material powder is pressed by using the upper punch. Then the lubricating oil and the molybdenum disulfide particles (and the insulating ceramic particles) enter between the particles of soft magnetic powder in accordance with the compression of the soft magnetic powder, so that the molybdenum disulfide particles (and the insulating ceramic particles) are interposed between the soft magnetic powder particles. Further advancing compression of the raw material powder, the distance between the soft magnetic powder particles is reduced, and most part of the lubricating oil that has entered between the soft magnetic powder particles is pushed out together with a part of the molybdenum disulfide particles (and the insulating ceramic particles) to return in the gap between the compact and the inner surface of die hole. However, the rest part of the molybdenum disulfide particles (and the insulating ceramic particles) remains between the soft magnetic powder particles together with a trace amount of lubricating oil. In the case of using the insulating ceramic particles, if there is a difference in affinity to the soft magnetic powder between the insulating ceramic particles and the molybdenum disulfide particles, a tendency arises during the compaction that the particles of high affinity are unevenly distributed in the vicinity of the surface of the soft magnetic powder particles, while the particles of low affinity are concentrated in the gap between the soft magnetic powder particles. The side surface of the powder compact after completion of the compaction, that is, the surface of the powder compact being in contact with the die hole becomes a state where the molybdenum disulfide particles and/or insulating ceramic particles are dispersed between the soft magnetic powder particles.

When pushing out the powder compact after completion of the compaction in the state in which the molybdenum disulfide particles (and the insulating ceramic particles) are dispersed between the particles of soft magnetic powder on the side surface of the powder compact that is in contact with the inner surface of the die hole, extrusion resistance is reduced by lubricating action of the lubricating oil and the molybdenum disulfide particles because the compact and the inner surface of die hole are in contact through the lubricating oil and the molybdenum disulfide particles. Therefore, the powder compact can be easily extracted. At this time, although the soft magnetic powder in contact with the inner surface of the die hole is going to cause plastic deformation by frictional resistance, deformation of the soft magnetic powder is prevented because the soft magnetic powder particles are supported on the moderate hardness of the molybdenum disulfide particles (and the insulating ceramic particles) interposing between the particles of soft magnetic powder. If the frictional resistance is increased, the stress is alleviated by rupture and cleavage of the intervening particles, thus it is possible to prevent plastic flow of the soft magnetic powder contacting with the inner surface of the die hole while performing the extraction of the powder compact. In this way, with the die in which the inner surface of the die hole is provided with the lubricating coating as described above and with the die assembly having that die, it is possible to suppress plastic flow of the particles in the sliding contact surface during the extrusion of the compact. Thus they are suitable as a die and a die assembly for manufacture of powder magnetic cores.

Description will be made about the lubricating composition used in forming the lubricating coating on the inner surface of the die hole.

The lubricating composition is a mixture obtained by mixing a lubricating oil and molybdenum disulfide particles (and the insulating ceramic particles), and it is possible to form, as it is, a lubricating coating containing molybdenum disulfide particles (and the insulating ceramic particles) and the lubricating oil. The lubricating oil acts as a dispersing medium for the solid material in the lubricating composition and loosely binds the molybdenum disulfide particles (and the insulating ceramic particles), thereby preparing the composition in the state of semisolid or highly viscous liquid capable of forming a film. Therefore, a flowable lubricating coating is formed by applying the lubricating oil in which the molybdenum disulfide particles (and the insulating ceramic particles) are dispersed (i.e. the lubricating composition) to the surface of die hole, thereby the molybdenum disulfide particles (and the insulating ceramic particles) are arranged on the surface of die hole. In addition, the lubricating oil in the lubricating coating reduces the friction, by its own lubricity, between the inner surface of the die hole and the side surface of the compact when extruding from the die hole the powder compact after the die pressing. Since molybdenum disulfide particles as is a solid lubricant are particularly effective in reducing static friction, the adoption of lubricating oil is intended to select it as a liquid lubricant of low viscosity, from the viewpoint of specialization so as to be effective in reducing the dynamic friction. With such a combination, the lubricating composition increases in effectiveness for reducing friction at the time of extrusion of the compact. Further the lubricating oil of the liquid state is easily absorbed by the capillary force in the gap of the soft magnetic powder and functions as a carrier for supplying the molybdenum disulfide particles (and the insulating ceramic particles) in the gap of the soft magnetic powder. In view of the above-described points, those of semisolid state such as grease or wax having high viscosity are not preferable, and the lubricating oil of liquid state is used. Lubricating oils are generally classified into two types of mineral oils obtained by purifying the crude oil and synthetic oils produced by a chemical process, and any type of lubricating oil may be used. The lubricating oils of the mineral oil type which are inexpensive and widely used are easy to use.

Even in the lubricating oil of liquid state, if the viscosity is too large, it is difficult to function as a carrier for supplying the molybdenum disulfide particles (and the insulating ceramic particles). Therefore, the viscosity of the lubricating oil is preferably 100,000 $mm^2/s$ or less. However, if the kinematic viscosity of the lubricating oil is too low, the coating cannot be kept on the surface of die hole to flow down, so that it is difficult to form a desired lubricating film. Therefore, the viscosity of the liquid lubricating oil is preferably set to 1,000 $mm^2/s$ or more.

Since it is possible to adjust the viscosity of the lubricating oil by blending a viscosity modifier such as thickeners or the like, the lubricating oil can be used by appropriately adding a thickening agent so as to exhibit a kinematic viscosity as described above. Further, it is possible to add a dispersing agent in order to uniformly disperse the molybdenum disulfide particle in the lubricating oil. In addition, it is also allowed to use an additive such as high molecular polymer or the like. Such an additive to use may be suitably selected from those commonly used.

The lubricating coating formed on the inner surface of the die hole suitably has such a composition that the ratio of molybdenum disulfide particles is 30 to 80% by mass, preferably 50 to 80% by mass, and more preferably 70 to 80% by mass, with respect to the total amount of the lubricating oil and molybdenum disulfide particles when not using the insulating ceramic particles, or with respect to the total amount of the lubricating oil, the insulating ceramic particles and the molybdenum disulfide particles when using the insulating ceramic particles. When the ratio of the molybdenum disulfide particles is less than 30% by mass, lubricity provided by the molybdenum disulfide particles is insufficient between the inner surface of the die hole and the side surface of the compact and it becomes impossible to sufficiently reduce the extrusion resistance of the compact. Therefore, it becomes difficult to suppress the plastic flow of the soft magnetic powder particles. On the other hand, when the ratio of the molybdenum disulfide particles exceeds 80% by mass, the amount of the lubricating oil is relatively poor. Therefore, film-forming ability is insufficient and it becomes difficult to uniformly fix the particle components on the inner surface of the die hole. And the function as a carrier to introduce the particle components to between the soft magnetic powder particles is reduced. In addition, the lubrication between the inner surface of the die hole and the soft magnetic powder, especially lubrication for dynamic friction, becomes insufficient and die galling is likely to occur, leading to plastic flow of the soft magnetic powder. Therefore, the lubricating composition used for forming the lubricating coating on the inner surface of the die hole is preferably prepared so that the ratio of the molybdenum disulfide particles is 30 to 80% by mass with respect to the total amount of the lubricating oil and molybdenum disulfide particles (and the insulating ceramic particles).

In the case of using the insulating ceramic particles, the lubricating coating formed on the inner surface of the die hole preferably has such a composition that the ratio of the insulating ceramic particles is 1 to 10% by mass and the ratio of molybdenum disulfide particle is 30 to 80% by mass, with respect to the total amount of the lubricating oil, the insulating ceramic particles and the molybdenum disulfide particles. If the ratio of the insulating ceramic particles is less than 1% by mass, it becomes difficult to make the insulating ceramic particles effectively interposed between the soft magnetic powder particles, so that the difficulty arises in improving the specific resistance at the side surface of the powder magnetic core. However, in the case where there is no fear of an increase in eddy current loss in the working frequency range of the powder magnetic core, the use of less than 1% by mass is acceptable. On the other hand, if the ratio of the insulating ceramic particles exceeds 10% by mass, the insulating ceramic particles present between the inner surface of the die hole and the powder compact becomes excessive and they wear out the inner surface of the die hole and the surface of the soft magnetic powder particles. In the case of the soft magnetic powder having the surface covered with insulating film, the insulating film tends to be destroyed. In addition, the wear of the die to be caused by abundant hard component is concerned and there is a possibility of a failure caused at the time of mass production. Therefore, the lubricating composition used in forming the lubricating coating on the inner surface of the die hole is prepared so that the ratio of the insulating ceramic particles is 1 to 10% by mass with respect to the total amount of the lubricating oil, the insulating ceramic particles and the molybdenum disulfide particles.

Upon preparation of the lubricating composition, if using a thickening agent, its mixing ratio is determined based on the mass of the lubricating oil in the state that the thickening agent has been added. If using a dispersing agent, it is preferably used in an amount of 1 to 10% by mass with respect to the molybdenum disulfide particles. For other additives, use in an amount of 1 to 10% by mass with respect to the molybdenum disulfide particles is preferable. In the preparation, additive agents that are used as needed are added to the lubricating oil, and they are uniformly mixed. Then adding and mixing the molybdenum disulfide particles (and the insulating ceramic particles) thereto, the lubricating composition can be favorably prepared.

The lubricating coating formed on the inner surface of the die hole of the die assembly is preferable to have a thickness of about 1 to 20 μm. When the thickness is thinner than 1 μm, the amount of lubricating oil is insufficient and it is not possible to sufficiently reduce the friction between the formed powder compact and the inner surface of the die hole, thereby it tends to cause plastic flow of the soft magnetic powder. At the same time, also the amount of molybdenum disulfide particles is insufficient and it tends to cause plastic flow of the soft magnetic powder. Further, in the case of a long axial length of the powder compact to be produced, it becomes easy to occur galling and adhesion to the die since the moving distance at the time of extrusion becomes longer. On the other hand, when the thickness of the lubricating coating is excessively large, the dimensions of the powder compact formed are correspondingly reduced, so that the dimensional accuracy is deteriorated. In addition, necessity arises to increase also the clearance between the die hole and the punch. Therefore, thickness of the lubricating coating is preferably about 1 to 20 μm.

In regard to the insulating ceramic particles, if using insulating ceramic particles subjected to surface modification by using a coupling agent, organic (lipophilic) property is applied to the surface thereof and it becomes easy, in preparing the lubricating composition, to uniformly disperse the insulating ceramic particles in the liquid medium. Thus it is effective in forming, on the inner surface of the die hole, a uniform lubricating coating in which the insulating ceramic particles are uniformly dispersed. As the coupling agent, silane coupling agents, aluminate-based coupling agents, titanate-based coupling agents and the like are usable, and these coupling agents may be used in combination. In the case of using a silane coupling agent, the surface treatment layer is formed of a compound containing Si on the surface of the insulating ceramic particles. In the case of using an aluminate-based coupling agent, the surface treatment layer is formed of a compound containing Al on the surface of the insulating ceramic particles. In the case of using a titanate-based coupling agent or the like, the surface treatment layer is formed of a compound containing Ti on the surface of the insulating ceramic particles. The surface modification with a coupling agent can be applied appropriately in accordance with a known treatment method, and the surface modification with the silane coupling agent include, for example, direct processing method (dry, wet), integral blending method, a primer-type processing method, and the like. Alternatively, it is also possible to use an appropriate product of surface-modified insulating ceramic particles by selecting from the powder products provided on the market. The organic surface treatment layer as mentioned above is also an insulating coating. The powders for powder magnetic cores, used as a raw material of powder compaction, are generally coated with an inorganic phosphate coating or an organic silicone coating, and, if such a raw material for powder compaction is subjected to the surface modification with a coupling agent or the like and is then used for the insulating ceramic particles, contact between the insulating ceramic particles and the soft magnetic powder particles becomes easy at the time of die compacting. In other words, the surface modification of the insulating ceramic particles is not only effective in improving the dispersibility in the lubricating oil, but is also useful for improvement of affinity and adhesion to the soft magnetic powder particles. In particular, in the case where the sort magnetic powder has an insulating coating of silicone resin type on the particle surface, if using insulating ceramic particles whose surface was modified with a silane coupling agent, it becomes easy for the insulating ceramic particles to cover the surface of the soft magnetic powder particles or to be adsorbed on the surface at the die pressing, due to the high affinity to each other. Therefore, the insulating properties of the soft magnetic powder particles are increased and direct contact of the soft magnetic powder particles and the inner surface of the die hole is also reduced. In this time, the molybdenum disulfide particles that have lower affinity to the soft magnetic powder than the insulating ceramic particles tends to exist concentrated in the gap between the soft magnetic powder particles, and lubricate while being cleaved in the gap. Moreover, by the adsorption of the insulating ceramic particles on the soft magnetic powder particles, it is possible to maintain or improve the insulating state between the sliding contact surface of the powder compact and the die. Therefore, increase of the eddy current loss of the powder magnetic core due to insulation deterioration in the sliding contact surface can be suppressed. Thus the effectiveness of the present invention is enhanced remarkably by the use of insulating ceramic particles which has been subjected to suitable surface modification, depending to the surface properties of the soft magnetic powder particles.

As described above, in the manufacturing method of the powder compact for a magnetic core of the present invention, the frictional resistance during extrusion of the pressed powder compact from the die hole is reduced by the lubricating oil and molybdenum disulfide particles (and the insulating ceramic particles) which are contained in the fluid lubricating coating formed on the inner surface of the die hole of the die assembly, and deformation and plastic flow of the soft magnetic powder particles are thus suppressed. Therefore, there is no need to add a powder lubricant into the raw material powder itself. This point is advantageous in increasing the space factor of the soft magnetic powder in the powder compact after pressing, and it is possible to avoid: lowering in the fluidity of the raw material powder caused by addition of the powder lubricant to the raw material powder; lowering in the filling easiness in the cavity; and decrease in the space factor of the soft magnetic powder by the volume occupied with the powder lubricant itself.

It should be noted that the insulating ceramic particles described above have a low magnetic permeability and thus it should not be excluded from the present invention that the raw material powder contains insulating ceramic particles. In other words, when used as a powder magnetic core, it becomes such a powder magnetic core that the magnetic gap is dispersed and the magnetic permeability has constancy, by the insulating ceramic particles distributed into the pores of the powder compact. However, it is desired, in this case, to adjust the amount of the insulating ceramic particles to be added to the raw material powder, so as not to make difficult the compaction to high density by impairing the flowability and compactibility of the raw material powder due to an excess of the insulating ceramic particles, and so as not to lose the room for receiving the insulating ceramic particles from the lubricating coating between the particles of the soft magnetic powder to be compressed. From this point, in the case of adding the insulating ceramic particles into the raw material powder, it is preferable to restrict the addition amount of the insulating ceramic particles to 1.5% by mass or less with respect to the raw material powder so as to give the room that a sufficient amount of insulating ceramic particles may enter between the particles of the soft magnetic powder to be compacted, from the lubricating coating provided on the inner surface of the die hole.

The powder compact for a magnetic core as formed in the above manner may be further subjected to heat treatment, depending on the purpose. For example, in the case where the powder compact for a magnetic core contains a thermosetting resin as a binder, it is possible to perform a heat treatment of heating to the curing temperature of the thermosetting resin. Or, in the case where the powder compact for a magnetic core contains a thermoplastic resin as a binder, it is possible to perform a heat treatment of heating to the softening temperature of the thermoplastic resin. Further, there is a case of performing annealing heat treatment to release the compressive strain stored in the soft magnetic powder of the compact for a magnetic core in order to improve the hysteresis loss during use as a powder magnetic core, regardless of the presence or absence of binder, and such a heat treatment is also allowed to perform. The heat treatment mentioned above may be carried out in accordance with the conventional method. When a heat treatment as described above is carried out, the lubricating oil is decomposed and lost in the temperature rising process of the heat treatment. Since the lubricating oil and molybdenum disulfide do not diffuse into the iron-based matrix at the temperature range of heat treatment which is generally performed on the powder magnetic core, the influence on the magnetic properties of the resulting powder magnetic core is small.

Moreover, the formed green compact for a magnetic core is possibly used as it is as the powder magnetic core, without subjecting to heat treatment. In this case, since the lubricating oil is not lost, it remains in the state attached to the side surface of the powder magnetic core. In the case of removing the remaining lubricating oil, the surface of the green compact is washed with a solvent or the green compact is dipped in a solvent, etc., thereby the lubricating oil is dissolved in the solvent. Therefore, it can be easily removed from the surface layer of the green compact.

By preparing as described above, molybdenum disulfide particles are pushed in between the particles of soft magnetic powder and dispersed to the surface in the formed powder compact for a magnetic core. Therefore, plastic flow of the soft magnetic powder due to frictional resistance is suppressed when pushing the powder compact out of the die hole, and conducting between the soft magnetic powder particles can be prevented. Therefore, the present invention dos not require the process of acid washing, cutting, etc. that is performed in the powder compact obtained by the conventional method in order to remove the surface layer portion where the soft magnetic powder particles are conductive due to plastic flow. Further, the side surface of the manufactured powder compact for a magnetic core has molybdenum disulfide particles (and the insulating ceramic particles) that are arranged around the soft magnetic powder of the surface layer portion. Therefore, the insulating properties at the side surface are enhanced, and it is suitable for suppressing the increase in iron loss.

EXAMPLES

Example 1

(Preparation of Lubricating Composition)

As the lubricating oil, mineral oil (Nuto H32, manufactured by Exxon Mobil Corporation) was prepared to adjust the kinematic viscosity to each of the values in Table 1, using a thickener (SOLGAM SH 210, manufactured by SEIWA KASEI Co., Ltd.).

Formulation was performed so that the ratio of the molybdenum disulfide particles (particle size: 0.5 μm) to the total amount of the lubricating oil and molybdenum disulfide particles became the ratio described in Table 1 and it was uniformly dispersed to prepare each of the lubricating compositions of Sample Nos. A1-A19.

(Formation of Powder Compact)

A shaping cavity was constituted by fitting a lower punch into the pressing die having a cylindrical die hole at the inner diameter of 20 mm, and one of the lubricating compositions of Sample Nos. A1-A19 was applied (application amount: 0.1 cc) to the inner bore surface of the die hole and then dried, thereby a lubricating coating having a thickness of about 20 μm was formed on the inner bore surface.

As the raw material powder, an iron-based soft magnetic powder (Somaloy 110i (5P), manufactured by Höganäs AB, main particle fraction in the particle size distribution: 45 to 75 μm) was prepared. Charging it at amount of 60 g into the die hole formed with the lubricating coating in the above, die compacting of the raw material powder was performed at a compacting pressure of 1,200 MPa using an upper punch, and a cylindrical powder compact of each of Sample Nos. A1-A19 was obtained by its extrusion. The density of the powder compact was measured in accordance with the Archimedes method, and the density ratio of the compact was calculated. The results are shown in Table 1.

(Surface Observation on the Side of Compact)

The side surface of the obtained powder compact was observed with EPMA apparatus, and the area ratio (%) of molybdenum disulfide particles in the component map of the side surface was examined. The area ratio was determined by analyzing (threshold:RGB:160) the image captured at the magnification of 100 times with use of image analysis software (Quick grain standard). Furthermore, in order to evaluate the state of the soft magnetic powder particles in the side surface of the powder compact, presence or absence of junction of the soft magnetic powder particles in the SEM image of the side surface was examined. The presence or absence of junction was determined by the presence or absence of sliding mark in the SEM image as well as determined in the component map by EPMA by the presence or absence of flow of Fe element or by whether or not the Fe element is detected between the particles of the soft magnetic powder. That is, if the sliding mark is found, it results in apparent junction of soft magnetic powder. Even in the case where an apparent sliding mark is not confirmed, if the Fe element is detected between the particles of soft magnetic powder, it is considered that junction has occurred since the plastic flow of the soft magnetic powder has been produced. The result of determining the presence or absence of junction of the soft magnetic powder by the examination as described above is shown in Table 1.

Figure 3:
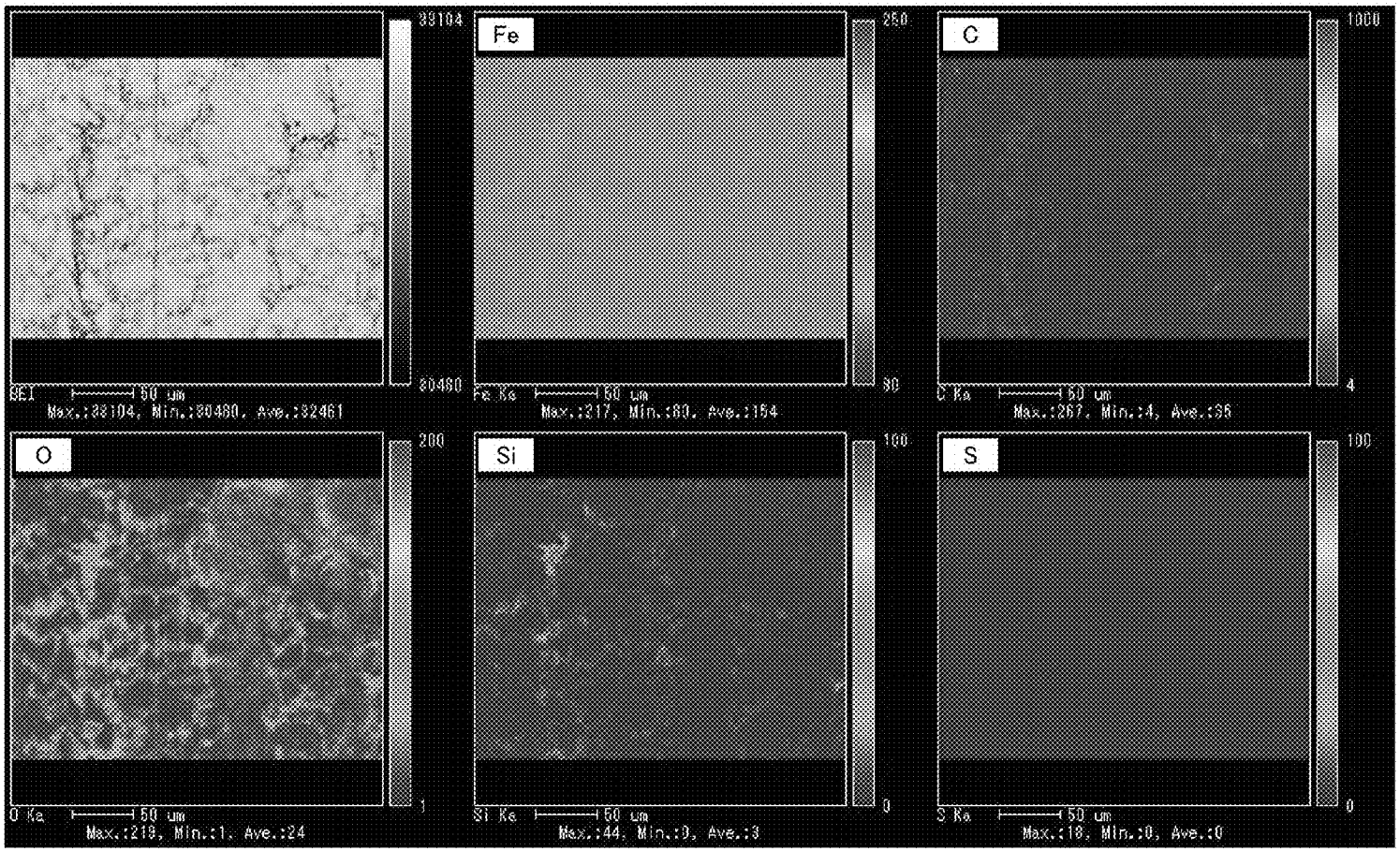
FIG. 3 It includes the SEM image (top left) and the component map (top right: C, upper center: Fe, lower right: S, lower center: Si, lower left: O) at the observation by EPMA apparatus, of the side surface of the powder compact that was prepared for the purpose of comparison in Examples.
Figure 4:
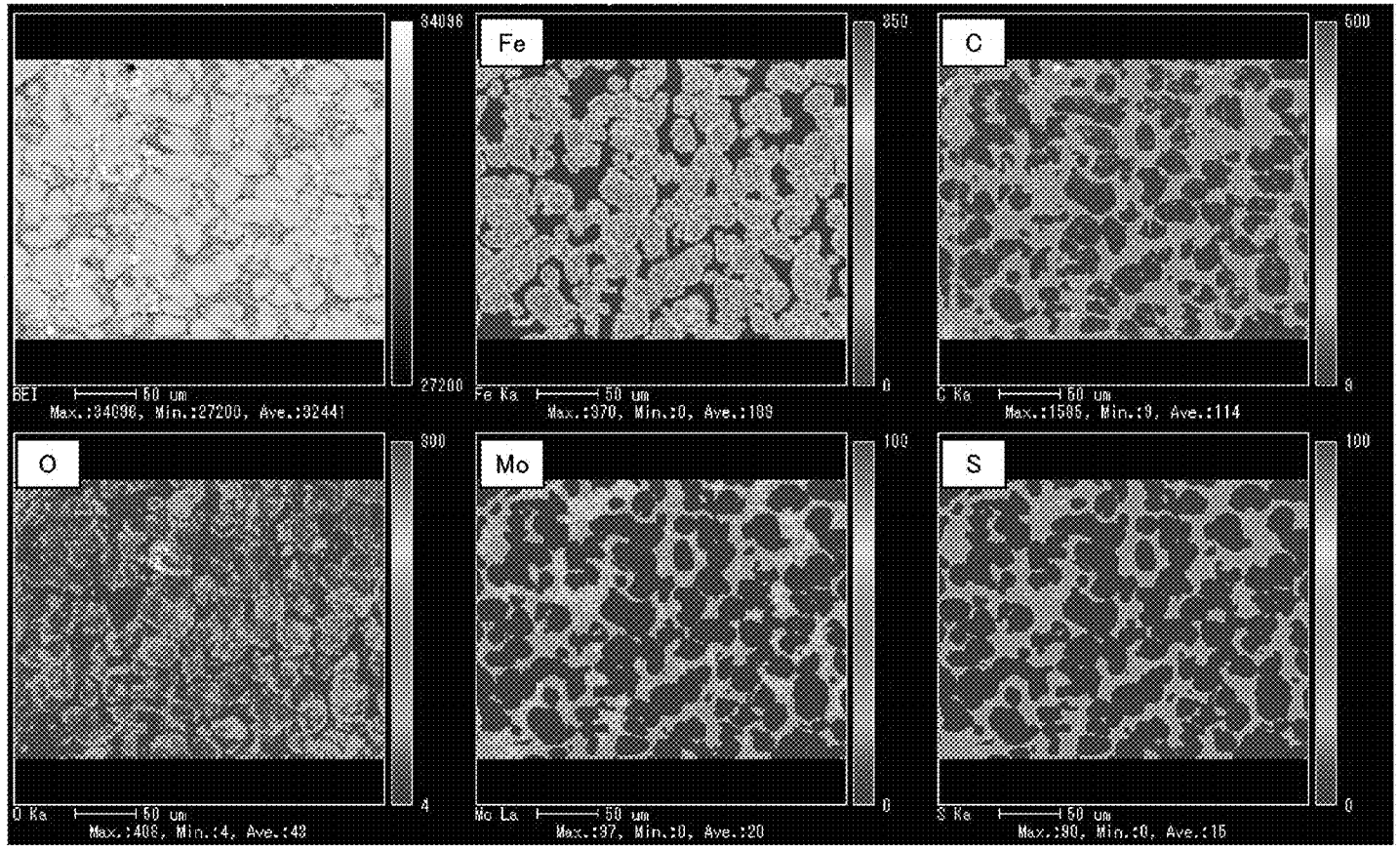
FIG. 4 It includes the SEM image (top left) and the component map (top right: C, upper center: Fe, lower right: S, lower center: Mo, lower left: O) at the observation by EPMA apparatus, of the side surface of the powder compact of Sample No. A5 that was prepared in Examples.

Further, for comparison, ethylene bis-stearic acid amide was applied to the inner surface of the die hole as the die lubricant, and, using this die hole, the iron-based soft magnetic powder mentioned above was compacted in the same manner to form a powder compact. The SEM image and component map in the side surface of this compact are shown in FIG. 3, and the SEM image and component map in the side surface of the compact of Sample No. A5 are shown in FIG. 4.

TABLE 1

| sample No. | kinematic viscosity of lubricating oil $mm^2/s$ | addition amount of molybdenum disulfide particles mass % | area ratio of molybdenum disulfide particles at side surface % | presence or absence of junction of soft magnetic powder | density ratio of compact % |
|---|---|---|---|---|---|
| A1 | 10000 | 10 | 16 | present | 94.0 |
| A2 | 10000 | 20 | 21 | present | 93.9 |
| A3 | 10000 | 30 | 33 | absent | 93.6 |
| A4 | 10000 | 40 | 39 | absent | 93.3 |
| A5 | 10000 | 50 | 46 | absent | 93.2 |
| A6 | 10000 | 60 | 52 | absent | 92.8 |
| A7 | 10000 | 70 | 58 | absent | 92.3 |
| A8 | 10000 | 80 | 65 | absent | 91.8 |
| A9 | 10000 | 90 | 72 | present | 90.8 |
| A10 | 500 | 50 | 12 | present | 93.7 |
| A11 | 1000 | 50 | 27 | absent | 93.6 |
| A12 | 2500 | 50 | 31 | absent | 93.5 |
| A13 | 5000 | 50 | 38 | absent | 93.4 |
| A14 | 7500 | 50 | 40 | absent | 93.3 |
| A5 | 10000 | 50 | 46 | absent | 93.2 |
| A15 | 25000 | 50 | 57 | absent | 93.1 |
| A16 | 50000 | 50 | 61 | absent | 93.0 |
| A17 | 75000 | 50 | 66 | absent | 92.9 |
| A18 | 100000 | 50 | 69 | absent | 92.8 |
| A19 | 200000 | 50 | 25 | present | 92.7 |

According to the results of Sample Nos. A3-A8 in Table 1, it can be seen that, by forming a lubricating coating consisting of mineral oil and 30 to 80% by mass of molybdenum disulfide particles onto the inner surface of the die hole, molybdenum disulfide particles are interposed between the soft magnetic powder particles and plastic flow of the soft magnetic powder can be suppressed at the time of extrusion of the compact. In addition, it can be understood from the results of Sample Nos. A11-A18 that it is preferable to use a lubricating oil having kinematic viscosity of about 1,000 to 100,000=$^2$/s. It is considered that the introduction amount of molybdenum disulfide particles to the powder compact is low in Sample No. A10 since the lubricating coating on the inner surface of the die hole caused the dripping, and it is considered that molybdenum disulfide particles in Sample No. A19 are difficult to enter between the soft magnetic powder particles due to high viscosity of the lubricating oil.

According to FIG. 3, streaks along the axial direction are appeared in the SEM image of the side surface of the powder compact using no molybdenum disulfide particles, and it is found that galling has occurred on the inner surface of the die hole. Further, from the fact that Fe has been detected over the entire map, it is understood that the gap between the soft magnetic powder particles has been filled. In other words, the soft magnetic powder particles in the side surface of the compact are crushed and the plastic flow has occurred apparently. In contrast, according to FIG. 4, streaks do not appear in the SEM image of the side surface of the powder compact of Sample No. A5 using the molybdenum disulfide particles and good lubrication is obtained without causing galling on the inner surface of the die hole. Further, Fe derived from the soft magnetic powder is detected as particulate form in the component map, and Mo and S derived from molybdenum disulfide particles are detected in the Fe-undetected part. In other words, molybdenum disulfide particles have been filled in the gap between the soft magnetic powder particles and plastic flow of the soft magnetic powder particles has been suppressed, thereby retaining the insulation between the particles.

It should be noted that, for the sake of confirmation, each of the compacts of Sample Nos. A2, A3, A8 and A9 was used as the core and winding a coil in the same number of turns, and the eddy current loss was measured under the same conditions of frequency: 50 KHz and magnetic flux density: 0.1 T. As a result of comparison between them, the eddy current loss was obviously less in the powder compacts of Sample Nos. A3 and A8, in comparison with that in the powder compacts of Sample Nos. A2 and A9.

Example 2

(Preparation of Lubricating Composition)

As the insulating ceramic particles, titanium oxide powder (particle size: 100 nm), alumina powder (particle size: 200 nm), silica powder (particle size: 100 nm), aluminum nitride powder (particle size: 100 nm), titanium nitride powder (particle size: 800 nm) and titanium carbide powder (particle size: 1,000 nm) were prepared. The insulating ceramic particles of these powders had an organic coating with surface modification using a silane coupling agent (n-butyltrimethoxysilane). In addition, as the lubricating oil, mineral oil (Nuto H32, manufactured by Exxon Mobil Corporation) was prepared to adjust the kinematic viscosity to each of the values in Table 2, with use of the thickener (SOLGAM SH210, manufactured by SEIWA KASEI Co., Ltd.).

The insulating ceramic particles and the molybdenum disulfide particles (particle size: 0.5 μm) were blended to the lubricating oil so that each of the ratios of the insulating ceramic particles and of the molybdenum disulfide particles with respect to total amount of the lubricating oil, the insulating ceramic particles and the molybdenum disulfide particles was respectively the ratio described in Table 2. Making into uniform dispersion, a lubricating composition was prepared in each of Sample Nos. B1-B28.

(Formation of Powder Compact)

A shaping cavity was constituted by fitting a lower punch into the pressing die having a cylindrical die hole at the inner diameter of 20 mm, and one of the lubricating compositions of Sample Nos. B1 to B28 was applied (application amount: 0.1 cc) to the inner bore surface of the die hole and then dried, thereby a lubricating coating having a thickness of about 20 μm was formed on the inner bore surface.

As the raw material powder, an iron-based soft magnetic powder (Somaloy 110i (5P), manufactured by Höganäs AB, main particle fraction in the particle size distribution: 45 to 75 μm) was prepared. Charging it at amount of 60 g into the die hole formed with the lubricating coating in the above, die compacting of the raw material powder was performed at a compacting pressure of 1,200 MPa using an upper punch, and a cylindrical powder compact of each of Sample Nos. B1 to B28 was obtained by its extrusion. The density of the powder compact was measured in accordance with the Archimedes method, and the density ratio of the compact was calculated. The results are shown in Table 2.

(Surface Observation on the Side of Compact)

The side surface of the obtained powder compact was observed with EPMA apparatus, and the area ratio (%) of molybdenum disulfide particles in the component map of the side surface was examined. The area ratio was determined in the same manner as in Example 1, by analyzing the image captured at the magnification of 100 times with use of image analysis software (Quick grain standard). Furthermore, in order to evaluate the state of the soft magnetic powder particles in the side surface of the powder compact, presence or absence of junction of the soft magnetic powder particles in the SEM image of the side surface was examined. The presence or absence of junction was determined in the same manner as in Example 1 by the presence or absence of sliding mark in the SEM image as well as determined in the component map by EPMA by the presence or absence of flow of Fe element or by whether or not the Fe element is detected between the particles of the soft magnetic powder. The result of determining the presence or absence of junction of the soft magnetic powder by the examination as described above is shown in Table 2.

Figure 5:
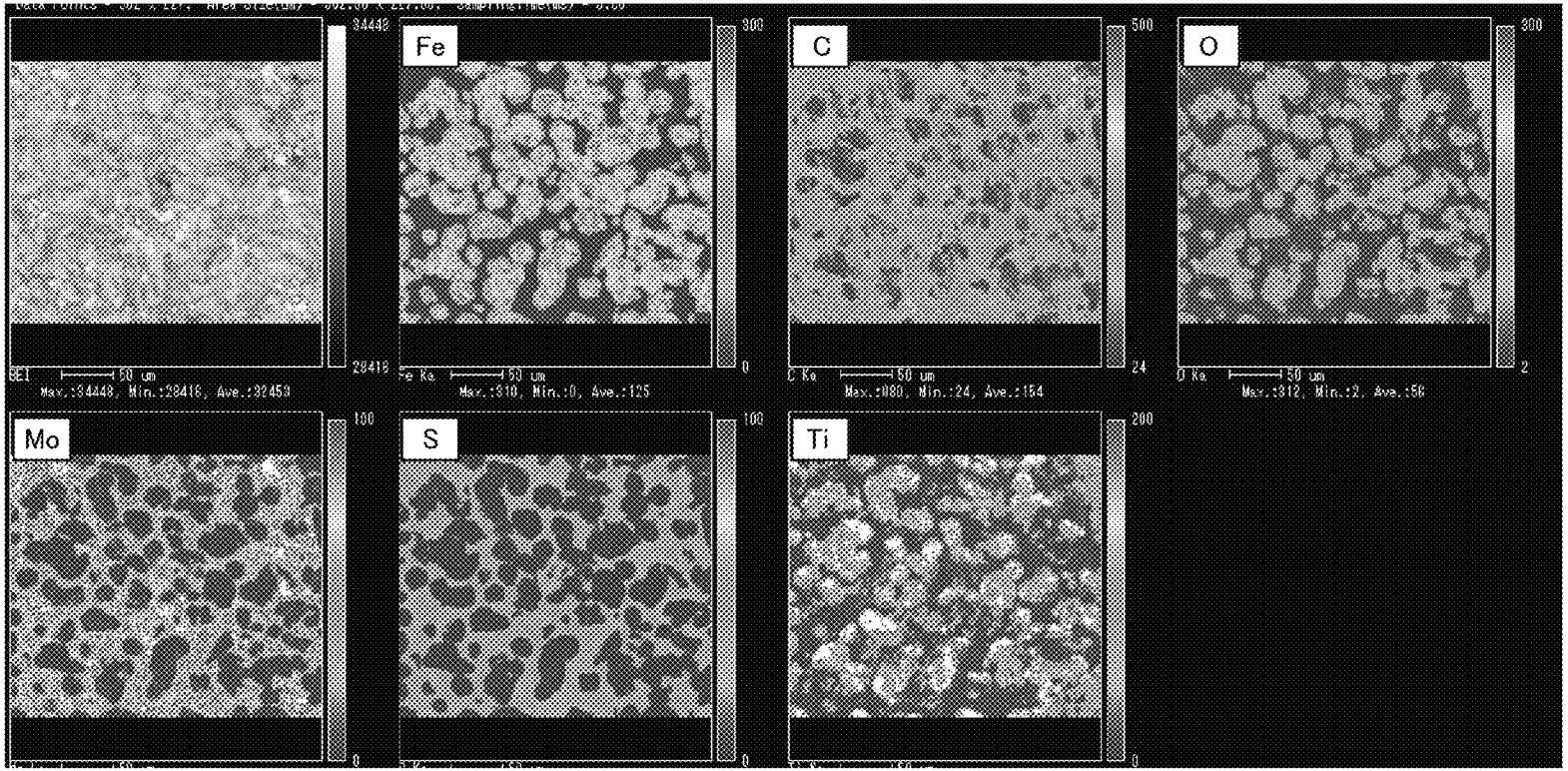
FIG. 5 It includes the SEM image (top left) and the component map (top: from right to left, O, C and Fe, lower: from right to left, Ti, S and Mo) at the observation by EPMA apparatus, of the side surface of the powder compact of Sample No. B4 that was prepared in Examples.

In addition, the SEM image and component map of the powder compact of Sample No. B4 are shown in FIG. 5.

TABLE 2

| sample No. | kinematic viscosity of lubricating oil $mm^2/s$ | insulating ceramic particles type | insulating ceramic particles addition amount mass % | addition amount of molybdenum disulfide particles mass % | area ratio of molybdenum disulfide particles on side surface % | presence or absence of junction of soft magnetic powder | density ratio of compact % |
|---|---|---|---|---|---|---|---|
| B1 | 10000 | $TiO_2$ | 1 | 50 | 35 | absent | 93.1 |
| B2 | 10000 | $TiO_2$ | 2 | 50 | 37 | absent | 93.4 |
| B3 | 10000 | $TiO_2$ | 3 | 50 | 37 | absent | 93.2 |
| B4 | 10000 | $TiO_2$ | 5 | 50 | 42 | absent | 93.3 |
| B5 | 10000 | $TiO_2$ | 7 | 50 | 42 | absent | 93.0 |
| B6 | 10000 | $TiO_2$ | 8 | 50 | 45 | absent | 93.0 |
| B7 | 10000 | $TiO_2$ | 10 | 50 | 55 | absent | 93.0 |
| B8 | 10000 | $TiO_2$ | 15 | 50 | 22 | present | 93.4 |
| B9 | 10000 | $Al_2O_3$ | 5 | 50 | 35 | absent | 93.1 |
| B10 | 10000 | $SiO_2$ | 5 | 50 | 39 | absent | 93.3 |
| B11 | 10000 | AlN | 5 | 50 | 42 | absent | 93.4 |
| B12 | 10000 | TiN | 5 | 50 | 41 | absent | 93.5 |
| B13 | 10000 | TiC | 5 | 50 | 42 | absent | 93.7 |
| B14 | 10000 | $TiO_2$ | 5 | 20 | 25 | present | 93.0 |
| B15 | 10000 | $TiO_2$ | 5 | 30 | 30 | absent | 93.1 |
| B16 | 10000 | $TiO_2$ | 5 | 40 | 36 | absent | 93.1 |
| B4 | 10000 | $TiO_2$ | 5 | 50 | 42 | absent | 93.3 |
| B17 | 10000 | $TiO_2$ | 5 | 60 | 56 | absent | 93.1 |
| B18 | 10000 | $TiO_2$ | 5 | 70 | 69 | absent | 93.2 |
| B19 | 10000 | $TiO_2$ | 5 | 80 | 72 | absent | 93.1 |
| B20 | 10000 | $TiO_2$ | 5 | 90 | 22 | present | 93.2 |
| B21 | 500 | $TiO_2$ | 5 | 50 | 11 | present | 93.5 |
| B22 | 1000 | $TiO_2$ | 5 | 50 | 32 | absent | 93.1 |
| B23 | 2500 | $TiO_2$ | 5 | 50 | 38 | absent | 93.0 |
| B24 | 5000 | $TiO_2$ | 5 | 50 | 40 | absent | 93.5 |
| B25 | 7500 | $TiO_2$ | 5 | 50 | 40 | absent | 93.5 |
| B4 | 10000 | $TiO_2$ | 5 | 50 | 42 | absent | 93.3 |

TABLE 2-continued

| sample No. | kinematic viscosity of lubricating oil $mm^2/s$ | insulating ceramic particles type | insulating ceramic particles addition amount mass % | addition amount of molybdenum disulfide particles mass % | area ratio of molybdenum disulfide particles on side surface % | presence or absence of junction of soft magnetic powder | density ratio of compact % |
|---|---|---|---|---|---|---|---|
| B26 | 25000 | $TiO_2$ | 5 | 50 | 55 | absent | 93.3 |
| B27 | 50000 | $TiO_2$ | 5 | 50 | 57 | absent | 93.2 |
| B28 | 75000 | $TiO_2$ | 5 | 50 | 62 | absent | 93.4 |
| B29 | 100000 | $TiO_2$ | 5 | 50 | 68 | absent | 93.3 |
| B30 | 200000 | $TiO_2$ | 5 | 50 | 15 | present | 93.4 |

According to the component map of the powder compact of Sample No. B4, titanium oxide particles and the molybdenum disulfide particles have a different detection area. The detection area of the titanium oxide particles corresponds to the detection area of the soft magnetic powder particles (Fe), and the detection area of the molybdenum disulfide particles is substantially matched to the region corresponding to the gap (the portion where Fe is not detected) between the soft magnetic powder particles. This is considered to be due to the fact that the insulating coating on the surface of the soft magnetic powder particles is an organic coating and the titanium oxide particles used has been subjected to organic surface modification with a coupling agent, and a high affinity between the soft magnetic powder particles and titanium oxide particles seems to cause the tendency that the titanium oxide particles are easily localized on the surface of the soft magnetic powder particles and the molybdenum disulfide particles are concentrated in the gap between the soft magnetic powder particles. Therefore, in the surface layer portion of the compact, although both of the titanium oxide particles and molybdenum disulfide particles are interposed between the soft magnetic powder particles, the outermost surface of the compact has titanium oxide particles surrounding the soft magnetic powder particle surface and detected in the detection region of the soft magnetic powder particles, while molybdenum disulfide is detected in the region corresponding to the gap between the soft magnetic powder particles. Based on this fact, the area ratio of the molybdenum disulfide particles (i.e., Mo and S) is used as an indicator for evaluating the surface layer portion of the compact in the component map.

According to the results of Sample Nos. B1-B7 and B15-B17 in Table 2, it can be seen that, by forming a lubricating coating containing 1 to 10% by mass of titanium oxide particles and 50 to 80% by mass of molybdenum disulfide particles on the inner surface of the die hole, titanium oxide particles and molybdenum disulfide particles are suitably introduced between the soft magnetic powder particles, thereby the area ratio of the molybdenum disulfide particles on the compact surface becomes 30% or more and plastic flow of the soft magnetic powder can be suppressed during the extrusion of the powder compact. Further, it can be seen from the results of Sample Nos. B9-B13 that alumina powder, silica powder, aluminum nitride powder, titanium nitride powder and titanium carbide powder can be used similarly as the insulating ceramic particles and plastic flow of the soft magnetic powder particles is possibly suppressed with them.

In addition, it can be seen from the results of Sample Nos. B19-B28 that it is preferable to use a lubricating oil having kinematic viscosity of about 1,000 to 100,000 $mm^2/s$. It is believed that, in sample No. B19, the lubricating coating on the inner surface of the die hole caused the dripping to decrease the introduction amount of molybdenum disulfide particles to the powder compact, and that the high viscosity of the lubricating oil in Sample No. B28 has made difficult for the molybdenum disulfide particles to enter in between the soft magnetic powder particles.

As mentioned above, according to FIG. 3, the soft magnetic powder particles of the side surface are crushed to obviously cause the plastic flow when the powder compact does not use either of the insulating ceramic particles or the molybdenum disulfide particles. In contrast, according to FIG. 5, streaks do not appear in the SEM image of the side surface of the powder compact of Sample No. B4 using the insulating ceramic particles and the molybdenum disulfide particles, and good lubrication has been obtained without occurring the galling of the inner surface of the die hole. Further, in the component map, Fe derived from the soft magnetic powder has been detected as particulate form and Ti derived from the insulating ceramic particles has been detected in the detection portion of Fe. That is, titanium oxide particles are in close contact with the surface of the soft magnetic powder particles. In contrast, in regard to Mo and S derived from the molybdenum disulfide particles, detection has been made on the portion having no Fe detection. In other words, the molybdenum disulfide particles have been filled in the gap between the soft magnetic powder particles.

It is noted that, for the sake of confirmation, each of the compacts of Sample Nos. B1 and B28 was used as the core with winding a coil in the same number of turns, and eddy current loss was measured under the same condition of frequency: 50 kHz, and magnetic flux density: 0.1 T. As a result of comparison between them, eddy current loss in the powder compact of Sample No. B1 was clearly less in comparison with that of the powder compact of Sample No. B28.

Example 3

(Preparation of Lubricating Composition)

As the insulating ceramic particles, titanium oxide powder (particle size: 100 nm) and silica powder (particle size: 100 nm) which have not been subjected to surface modification were prepared. In addition, kinematic viscosity of mineral oil (Nuto H32, manufactured by Exxon Mobil Corporation) was adjusted to 10,000$^{=2}$/s with use of the thickener (SOLGAM SH210, manufactured by SEIWA KASEI Co., Ltd.), which was prepared as the lubricating oil.

The insulating ceramic particles and the molybdenum disulfide particles (particle size: 0.5 μm) were blended to the lubricating oil so that each of the ratios of the insulating ceramic particles and of the molybdenum disulfide particles with respect to total amount of the lubricating oil, the insulating ceramic particles and the molybdenum disulfide particles was respectively 5% by mass and 50% by mass. Making uniform dispersion, a lubricating composition was prepared for each of Sample No. B29 (titanium oxide powder) and Sample No. B30 (silica powder).

(Formation of Powder Compact)

A shaping cavity was constituted by fitting a lower punch into the pressing die having a cylindrical die hole at the inner diameter of 20 mm, and one of the lubricating compositions of Sample Nos. B29-B30 was applied (application amount: 0.1 cc) to the inner bore surface of the die hole and then dried, thereby a lubricating coating having a thickness of about 20 μm was formed on the inner bore surface.

As the raw material powder, an iron-based soft magnetic powder having insulation-coated surface (Somaloy 110i (5P), manufactured by Höganäs AB, main particle fraction in the particle size distribution: 45 to 75 μm) was prepared. Charging it at amount of 60 g into the die hole formed with the lubricating composition in the above, die compacting of the raw material powder was performed at a compacting pressure of 1,200 MPa using an upper punch, and a cylindrical powder compact of each of Sample Nos. B29-B30 was obtained by its extrusion. The density of the powder compact was measured in accordance with the Archimedes method, and the density ratio of the compact was calculated. The density ratio was respectively 93.3% (Sample No. B29) and 93.4% (Sample No. B30).

(Surface Observation on the Side of Compact)

The side surface of the obtained powder compact was observed with EPMA apparatus, and the area ratio (%) of molybdenum disulfide particles in the component map of the side surface was examined. The area ratio was determined in the same manner as in Example 1, by analyzing the image captured at the magnification of 100 times with use of image analysis software (Quick grain standard). Furthermore, in order to evaluate the state of the soft magnetic powder particles in the side surface of the powder compact, presence or absence of junction of the soft magnetic powder particles in the SEM image of the side surface was examined. The presence or absence of junction was determined in the same manner as in Example 1 by the presence or absence of sliding mark in the SEM image as well as determined in the component map by EPMA by the presence or absence of flow of Fe element or by whether or not the Fe element is detected between the particles of the soft magnetic powder. As a result, junction of the soft magnetic powder particles was absent in any of the compacts of Sample No. B29 and Sample No. B30.

Figure 6:
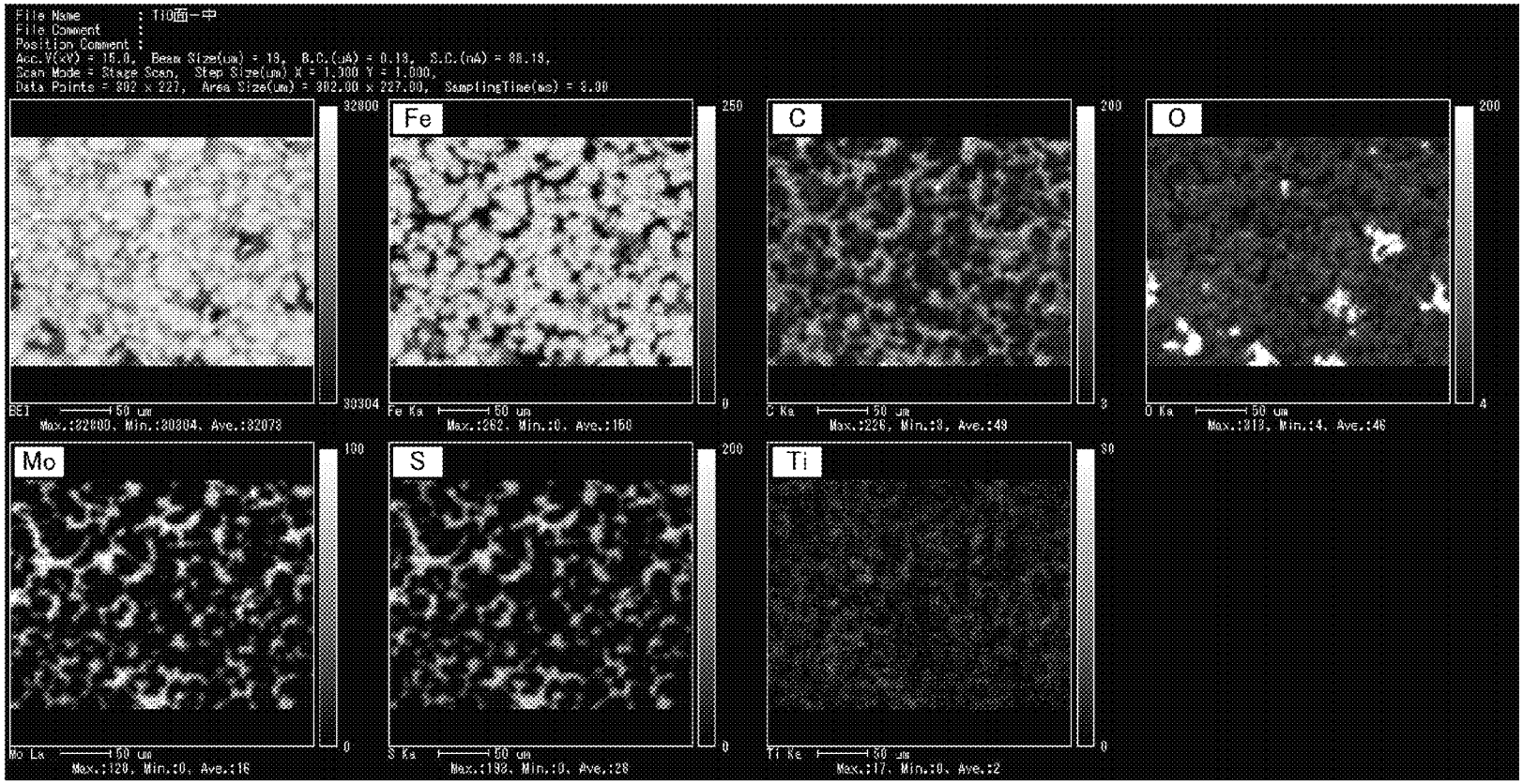
FIG. 6 It includes the SEM image (top left) and the component map (top: from right to left, O, C and Fe, lower: from right to left, Ti, S and Mo) at the observation by EPMA apparatus, of the side surface of the powder compact of Sample No. B29 that was prepared in Examples.

In addition, the SEM image and component map of the powder compact of Sample No. B29 are shown in FIG. 6. Comparing this with Sample No. B4 of FIG. 5, a difference can be seen at the point that the component element (Ti) of the insulating ceramic particles in sample No. B29 does not exhibit such a distribution to surround the soft magnetic powder particles. That is, the insulating ceramic particles are distributed intensively in the gap of the soft magnetic powder particles, as well as the molybdenum disulfide particles. Therefore, it is understood that the affinity of the insulating ceramic particles to the soft magnetic powder is comparable to that of the molybdenum disulfide particles due to no organic coating given by surface modification and they are thus embedded in admixture with molybdenum disulfide between the soft magnetic powder particles during the compacting. Incidentally, it has been confirmed about this point that the same applies to the powder compact of Sample No. B30 using the silica powder as the insulating ceramic particles.

Furthermore, each of the compacts of Sample No. A5 in Example 1, Sample No. B4 in Example 2 and Sample No. B29 in Example 3 was used as the core with winding a coil in the same number of turns, and eddy current loss was measured under the same condition of frequency: 50 kHz, and magnetic flux density: 0.1 T. As a result of comparison between them, eddy current loss in the powder compact of Sample No. B4 was the smallest, and it was smaller in the second in the powder compact of Sample No. B29.

INDUSTRIAL APPLICABILITY

A powder magnetic core of the present invention can be applied to a transformer, a reactor, a thyristor valve, a noise filter, a choke coil and the like. Further, it can also be applied to an iron core for motors, a yoke and a rotor of a motor for general consumer electronics or industrial equipment, and a solenoid core (fixed iron core) of an electromagnetic valve to be incorporated into the electronically controlled fuel injection system for diesel engines or gasoline engines, and the like. It is highly effective in particular in application to a reactor or the like used in a high frequency region.

The invention claimed is:

1. A powder magnetic core, being configured of a powder compact that a soft magnetic powder is compacted at a density ratio of 91% or more than 91%, the powder compact comprising, on an extrusion-sliding surface:

a surface layer portion having a structure where molybdenum disulfide particles and insulating ceramic particles are interposed between particles of the soft magnetic powder, wherein the insulating ceramic particles are composed of at least one ceramic selected from the group consisting of oxide ceramics, nitride ceramics, carbide ceramics, carbonitride ceramics and oxynitride ceramics, wherein the nitride ceramics are at least one selected from the group consisting of aluminum nitride, titanium nitride and silicon nitride.

2. The powder magnetic core as set forth in claim 1, wherein the extrusion-sliding surface of the powder compact is covered with at least one of insulating ceramic particles and molybdenum disulfide particles.

3. The powder magnetic core as set forth in claim 1, wherein the insulating ceramic particles have a particle size of 50 to 1,000 nm, and the molybdenum disulfide particles have a particle size of 100 to 1,000 nm.

4. The powder magnetic core as set forth in claim 1, wherein the oxide ceramics are at least one selected from the group consisting of aluminum oxide, titanium dioxide, silicon dioxide, magnesium oxide, zirconium dioxide, steatite, zircon, ferrite, mullite, forsterite and yttria, and the carbide ceramics are at least one selected from the group consisting of titanium carbide and tungsten carbide.

5. The powder magnetic core as set forth in claim 1, wherein the insulating ceramic particles have a surface formed with a coating composed of a compound containing at least one element of Si, Al and Ti.

6. The powder magnetic core as set forth in claim 1, wherein an area ratio of the molybdenum disulfide particles is 30% or more than 30% in a component map according to electron probe micro-analysis of the extrusion-sliding surface.

7. The powder magnetic core as set forth in claim 1, wherein the particles of the soft magnetic powder has an insulating film covering the surface, and the insulating film comprises at least one of silane coupling agents and silicone resins.

8. A method of manufacturing a powder compact for a magnetic core, comprising:

filling a soft magnetic powder in a die hole of a die for compaction;

pressing the soft magnetic powder to form a powder compact so that a density ratio of the soft magnetic powder is 91% or more than 91%; and extruding the powder compact from the die hole, wherein the manufacturing method further comprises, before the charging the soft magnetic powder;

forming a lubricating coating containing a lubricating oil, insulating ceramic particles and molybdenum disulfide particles on an inner surface of the die hole that makes sliding contact with the powder compact at the extruding.

9. The manufacturing method of a powder compact for a magnetic core as set forth in claim 8, wherein the lubricating coating contains the insulating ceramic particles at a ratio of 1 to 10% by mass and the molybdenum disulfide particles at a ratio of 30 to 80% by mass, respectively, with respect to the total amount of the lubricating oil and the molybdenum disulfide particles.

10. The manufacturing method of a powder compact for a magnetic core as set forth in claim 8, herein the lubricating coating is formed by applying a lubricating composition containing the lubricating oil, the insulating ceramic particles and the molybdenum disulfide particles to the inner surface of the die hole.

11. The manufacturing method of a powder compact for a magnetic core as set forth in claim 8, wherein the insulating ceramic particles have a particle size of 50 to 1,000 nm, and the molybdenum disulfide particles have a particle size of 100 to 1,000 nm.

12. The manufacturing method of a powder compact for a magnetic core as set forth in claim 8, wherein the insulating ceramic particles are composed of at least one ceramic selected from the group consisting of oxide ceramics, nitride ceramics, carbide ceramics, carbonitride ceramics and oxynitride ceramics.

13. The manufacturing method of a powder compact for a magnetic core as set forth in claim 8, wherein the insulating ceramic particles have a surface modified by at least one coupling agent selected from the group consisting of silane coupling agents, aluminate coupling agents and titanate coupling agents.

14. The manufacturing method of a powder compact for a magnetic core as set forth in claim 8, wherein the lubricating coating has a thickness of 1 to 20 μm.

15. The manufacturing method of a powder compact for a magnetic core as set forth in claim 8, wherein the lubricating oil has a kinematic viscosity of 1,000 to 100,000 $mm^2/s$.

16. The manufacturing method of a powder compact for a magnetic core as set forth in claim 12, wherein the nitride ceramics are at least one selected from the group consisting of aluminum nitride, titanium nitride and silicon nitride.

17. The manufacturing method of a powder compact for a magnetic core as set forth in claim 16, wherein the oxide ceramics are at least one selected from the group consisting of aluminum oxide, titanium dioxide, silicon dioxide, magnesium oxide, zirconium dioxide, steatite, zircon, ferrite, mullite, forsterite and yttria, and the carbide ceramics are at least one selected from the group consisting of titanium carbide and tungsten carbide.

* * * * *